US005986527A

United States Patent [19]

Ishikawa et al.

[11] Patent Number: 5,986,527

[45] Date of Patent: Nov. 16, 1999

[54] PLANAR DIELECTRIC LINE AND INTEGRATED CIRCUIT USING THE SAME LINE

[75] Inventors: Yohei Ishikawa, Kyoto; Toshiro Hiratsuka, Kusatsu; Sadao Yamashita, Kyoto; Kenichi Iio, Nagaokakyo, all of Japan

[73] Assignee: Murata Manufacturing Co., Ltd., Japan

[21] Appl. No.: 08/832,305

[22] Filed: Apr. 3, 1997

Related U.S. Application Data

[63] Continuation-in-part of application No. 08/623,460, Mar. 28, 1996, abandoned.

[30] Foreign Application Priority Data

Mar. 28, 1995 [JP] Japan ..... 7-69867

[51] Int. Cl.[6] ..... H01P 3/00; H01P 3/16

[52] U.S. Cl. ..... 333/239; 333/248; 333/249

[58] Field of Search ..... 333/1, 238, 239, 333/246, 247, 248, 249

[56] References Cited

U.S. PATENT DOCUMENTS 2,673,962 3/1954 Kock ..... 333/249
4,425,549 1/1984 Schwartz et al. ..... 333/239 X

OTHER PUBLICATIONS

H.C.C. Fernandes et al., "Metallization Thickness In Bilateral and Unilateral Finlines", Int'l. Jrnl. of Infrared and Millimeter Waves, vol. 15, No. 6, pp. 1008, Line 14, 1009, Line 8, Jun. 6, 1994.

J.J. Lee, "Slotline Impedance", IEEE Transactions on MTT, vol. 39, No. 4, pp. 666–672, Apr. 1991.

*Primary Examiner*—Paul Gensler
*Attorney, Agent, or Firm*—Ostrolenk, Faber, Gerb & Soffen, LLP

[57] ABSTRACT

A small and inexpensive planar dielectric line that can be easily connected to electronic parts, such as ICs, and has smaller conduction losses. The planar dielectric line includes a dielectric substrate having first and second surfaces opposedly facing each other. A first slot having a predetermined width is interposed between first and second electrodes on the first surface of the dielectric substrate. A second slot having the same width as the first slot is disposed between third and fourth electrodes on the second surface of the dielectric substrate. The first and second slots opposedly face each other. The permittivity and the thickness of the dielectric substrate are determined so that a planar electromagnetic wave can propagate in a propagation region of the substrate interposed between the first and second slots while being substantially totally reflected on the first surface of the substrate adjacent to the first slot and the second surface of the substrate near the second slot. When the permittivity and the thickness of the dielectric substrate are determined to meet the following conditions, 80% or more of the total electric field energy is confined within a region which is small enough to substantially eliminate interference with an adjacent line:

(relative permittivity of dielectric substrate)≧10 (thickness "t" of dielectric substrate)≧0.3 mm. When the relative permittivity is at least 18, 90% or more of the total electric field energy is confined.

15 Claims, 26 Drawing Sheets

RELATIONSHIP BETWEEN DISTANCE AND FREQUENCY WHICH ACHIEVES CONFINEMENT OF 80% OR GREATER

RELATIONSHIP BETWEEN DISTANCE AND SUBSTRATE THICKNESS WHICH ACHIEVES CONFINEMENT OF 80% OR GREATER

RELATIONSHIP BETWEEN DISTANCE AND FREQUENCY WHICH ACHIEVES CONFINEMENT OF 90% OR GREATER

RELATIONSHIP BETWEEN DISTANCE AND SUBSTRATE THICKNESS WHICH ACHIEVES CONFINEMENT OF 90% OR GREATER

FREQUENCY DEPENDENCE IN LOSS VS. RELATIVE PERMITIVITY
(SUBSTRATE THICKNESS 0.5MM)

RELATIVE PERMITIVITY VS. LOSS (FREQUENCY; 30GHZ)

PLANAR DIELECTRIC LINE AND INTEGRATED CIRCUIT USING THE SAME LINE

CROSS-REFERENCE TO RELATED APPLICATION

This application is a continuation-in-part application of U.S. patent application Ser. No. 08/623,460, now abandoned.

BACKGROUND OF THE INVENTION

1. Field of the Invention

The present invention relates to a planar dielectric line for use in a microwave or a millimeter-wave band. The invention also relates to an integrated circuit using the dielectric line.

2. Description of the Related Art

Microwaves and millimeter-waves, which are electromagnetic waves in a very wide frequency band ranging from 300 MHz to 300 GHz, are used in various types of radar, terrestrial long-distance telephone transmission, television broadcasting relays, satellite communications, etc. Such waves are also coming into a wide use in the field of mobile communications. Meanwhile, research is being actively carried out in the development of MMICs, and progress is being made in the downsizing of equipment utilizing electromagnetic waves in a band including microwaves and millimeter-waves. Accordingly, the microwaves and millimeter-waves are increasingly coming into a wider range of uses.

Hitherto, the following type of transmission lines have been largely used in this band range of microwave and millimeter-waves: transmission lines, such as waveguides, coaxial lines, microstrip lines, coplanar lines, slotted lines, and so on. These types of lines are constructed by forming predetermined electrodes on a dielectric substrate. Waveguides are for use in portions where conduction losses should be inhibited to a low level. Coaxial lines are widely used as connecting cables between equipment. Also, microstrip lines, slotted lines, etc. are largely employed for the connection between electronic parts, such as ICs, since they are easily connected thereto.

A slotted line is, as shown in FIG. 19, constructed in such a manner that electrodes 421*a* and 421*b* are disposed across a predetermined spacing on the top surface of a dielectric substrate 423 having a predetermined thickness h400. This achieves the formation of a slot 424 having a predetermined width W400 sandwiched between the electrodes 421*a* and 421*b*. In the slotted line constructed as described above, an electromagnetic wave forms a mode having an electric field E400 in parallel to the width of the slot 424 and a magnetic field H400 in parallel to the longitudinal direction of the slot 424, thereby propagating in the longitudinal direction of the slot 424.

Further, in addition to the above-described transmission lines, nonradiative dielectric waveguides (NRD) are used. An NRD is constructed in such a manner that a rectangular-prism dielectric is interposed between conductive plates and has a low level of conduction losses.

Waveguides, which are of large size, cannot however achieve downsizing and weight reduction and are difficult to connect with electronic parts, such as ICs. On the other hand, in coaxial lines, an unnecessary high-order mode is generated at a frequency higher than a specific frequency determined by the cross sectional configuration of the coaxial lines so as to increase conduction losses, thus rendering the lines inoperable. In order to avoid this problem, it is necessary to reduce the diameter of the coaxial line to approximately 1 mm when the line is used at a frequency in a millimeter-wave band range of as high as 60 GHz, which makes it difficult to manufacture. Microstrip lines, coplanar lines and slotted lines exhibit extremely large conduction losses. Additionally, NRD lines are difficult to connect to electronic parts, such as ICs.

SUMMARY OF THE INVENTION

Accordingly, in order to overcome the above-described drawbacks, the present invention is able to provide a small and inexpensive planar dielectric line which can be easily connected with electronic parts, such as ICs and the like, and in which conduction losses can be reduced to a much smaller level than in microstrip lines, coplanar lines, slotted lines and so on.

It is another advantage of the present invention to provide an integrated circuit with comparatively improved integrity.

In order to achieve the above advantages, according to a first aspect of the present invention, there is provided a planar dielectric line comprising: a dielectric substrate having first and second surfaces which opposedly face each other; a first slot having a predetermined width and being interposed between first and second electrodes, the first and second electrodes being formed on the first surface of the dielectric substrate and opposedly facing each other across a predetermined spacing; and a second slot having substantially the same width as the first slot and being interposed between third and fourth electrodes, opposedly facing the first slot, the third and fourth electrodes being formed on the second surface of the dielectric substrate and opposedly facing each other across a predetermined spacing; wherein the permittivity and the thickness of the dielectric substrate are determined to meet the following conditions:

(relative permittivity of dielectric substrate)$\geqq$10 (thickness "t" of dielectric substrate)$\geqq$0.3 mm.

Upper and lower air layers may be provided above and below the dielectric substrate.

Preferably, the thickness "t" of the dielectric substrate and the thickness "a" of each air layer are determined to meet the following conditions:

$t \leqq \lambda_g/2$ $\lambda_g$: wavelength in dielectric substrate $a \leqq \lambda_0/2$ $\lambda_0$: free space wavelength.

According to another aspect of the present invention, there is provided a planar dielectric line comprising: a dielectric substrate having first and second surfaces which opposedly face each other; a first slot having a predetermined width and being interposed between first and second electrodes, the first and second electrodes being formed on the first surface of the dielectric substrate and opposedly facing each other across a predetermined spacing; and a second slot having substantially the same width as the first slot and being interposed between third and fourth electrodes, opposedly facing the first slot, the third and fourth electrodes being formed on the second surface of the dielectric substrate and opposedly facing each other across a predetermined spacing; wherein the permittivity and the thickness of the dielectric substrate are determined to meet the following conditions:

(relative permittivity of dielectric substrate)$\geqq$18 (thickness "t" of dielectric substrate)$\geqq$0.3 mm.

Upper and lower air layers may be provided above and below the dielectric substrate.

Preferably, the thickness "t" of the dielectric substrate and the thickness "a" of each air layer are determined to meet the following conditions:

$t \leqq \lambda_g/2$ $\lambda_g$: wavelength in dielectric substrate $a \leqq \lambda_0/2$ $\lambda_0$: free space wavelength.

With the invention as described herein, the distance between two adjacent PDTLs (planar dielectric transmission lines) can be decreased since signals propagating in the PDTLs can be substantially confined in each line.

These and other features and advantages of the present invention will become clear from the following description of embodiments of the invention when read in conjunction with the accompanying drawings.

DESCRIPTION OF EMBODIMENTS OF THE INVENTION

First Embodiment

A detailed explanation will now be given of a planar dielectric line LN10 according to a first embodiment of the present invention with reference to the drawings.

Figure 1:
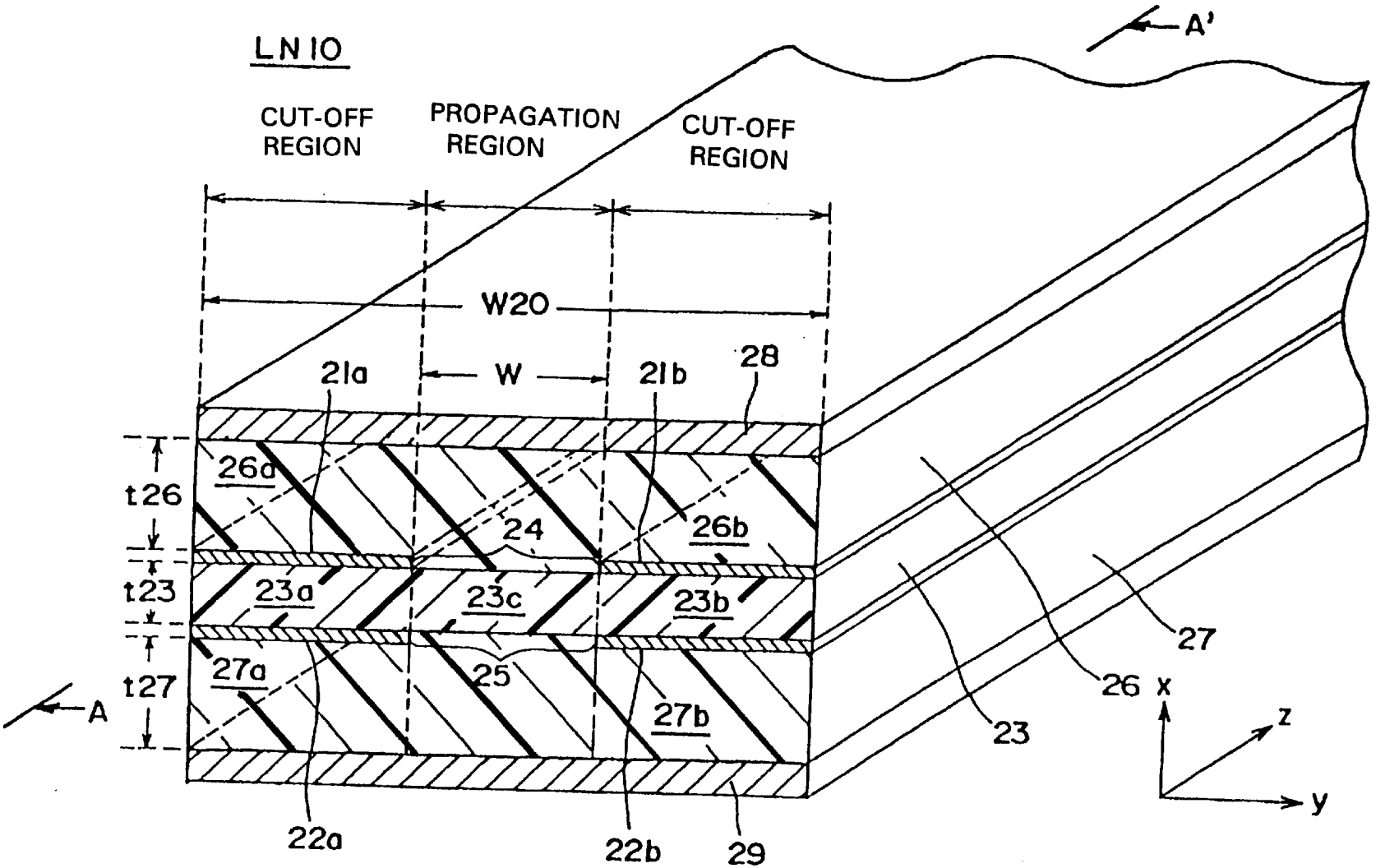
FIG. 1 is a perspective view of a planar dielectric line LN10 according to a first embodiment of the present invention.

Referring to FIG. 1, a dielectric substrate 23 has a predetermined thickness t23 and a predetermined width W20, with its length being sufficiently longer than its width W20. Disposed on the top surface of the dielectric substrate 23 are electrodes 21*a* and 21*b* opposedly facing each other across a predetermined spacing. With this arrangement, a slot 24 having a predetermined width W is formed between the electrodes 21*a* and 21*b* and is located in the central portion of the dielectric substrate 23 along its width and in parallel to the substrate 23 in the longitudinal direction.

Disposed on the bottom surface of the dielectric substrate 23 are electrodes 22*a* and 22*b* opposedly facing each other across a predetermined spacing. With this arrangement, a slot 25 having the same width W of the slot 24 is formed between the electrodes 22*a* and 22*b* and is located in the central portion of the dielectric substrate 23 along its width and in parallel to the substrate 23 in the longitudinal direction. The slots 24 and 25 are formed opposedly facing each other. The dielectric substrate 23 interposed between the slots 24 and 25 serves as a propagation region 23*c* in which a high-frequency signal having a desired propagation frequency fb is transmitted, as will be described below in greater detail.

Directly deposited on the top surface of the dielectric substrate 23 having the electrodes 21*a* and 21*b* mounted thereon is another dielectric substrate 26 with the same width W20 and length as the substrate 23. An electrode 28 is further mounted on the overall top surface of the dielectric substrate 26. Also, directly formed on the bottom surface of the dielectric substrate 23 having the electrodes 22*a* and 22*b* mounted thereon is a dielectric substrate 27 having the same width W20 and length as the dielectric substrate 23. An electrode 29 is disposed on the entire bottom surface of the dielectric substrate 27.

In regard to specific permittivity, the specific permittivity $\in_r$26 of the dielectric substrate 26 is set to be equal to the specific permittivity $\in_r$27 of the dielectric substrate 27. On the other hand, the specific permittivity $\in_r$23 of the dielectric substrate 23 is set larger than the specific permittivity $\in_r$26 and $\in_r$27, as will be explained below.

Figure 2:
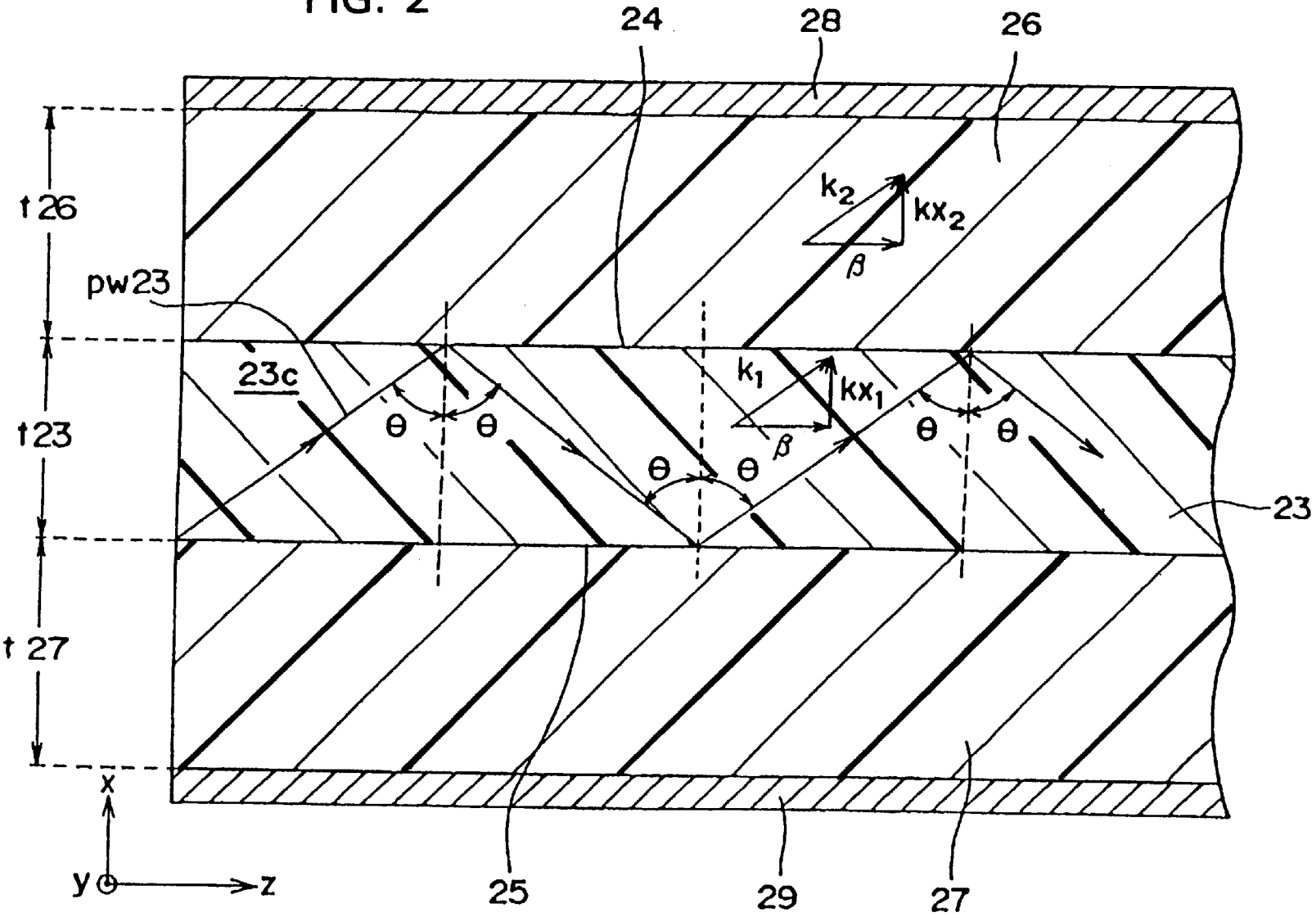
FIG. 2 is a longitudinal sectional view along line A–A' of FIG. 1.

FIG. 2 is a longitudinal sectional view of the planar dielectric line LN10 taken along line A–A' of FIG. 1. FIG. 2 shows that a planar electromagnetic wave pw23 is incident on a point of the top surface of the dielectric substrate 23 adjacent to the slot 24 at a predetermined angle of incidence θ and is reflected at an angle of reflection θ equal to the angle of incidence. The top surface of the dielectric substrate 23 adjacent to the slot 24 forms a boundary between the dielectric substrates 23 and 26. The planar electromagnetic wave pw23, reflected at a point on the top surface of the dielectric substrate 23 near the slot 24, is incident on a point of the bottom surface of the dielectric substrate 23 adjacent to the slot 25 at an angle of incidence θ and is reflected at an angle of reflection θ equal to the angle of incidence. The bottom surface of the dielectric substrate 23 in the vicinity of the slot 25 constitutes a boundary between the dielectric substrates 23 and 27. Thereafter, the electromagnetic wave pw23 propagates as a transverse electric (TE) mode within the propagation region 23*c* of the dielectric substrate 23 while being repeatedly reflected alternately on the top surface of the dielectric substrate 23 adjacent to the slot 24 and on the bottom surface of the substrate 23 close to the slot 25. An electromagnetic wave propagating in the TE mode will hereinafter be referred to as a "TE wave".

The angle of incidence θ at which the electromagnetic wave pw23 impinges on a point on the top surface and a point on the bottom surface of the dielectric substrate 23 is defined as the angle between the direction in which the electromagnetic wave pw23 travels and the normal at the incident point on the slot 24 or the slot 25. The angle θ can be expressed by the following mathematical equation 1 with the use of the propagation constant k of the planar electromagnetic wave pw23 and the phase constant β of the TE wave propagating in the longitudinal direction of the dielectric substrate 23. If the angle of incidence θ is larger than the critical angle θdc expressed by the following mathematical equation 2, the electromagnetic wave pw23 is totally reflected on the top surface of the dielectric substrate 23 adjacent to the slot 24 and the bottom surface of the substrate 23 in the vicinity of the slot 25, thus propagating within the propagation region 23*c* of the substrate 23 without attenuating. On the other hand, if the angle of incidence θ is smaller than the critical angle θdc, the electromagnetic wave pw23 partially transmits the dielectric substrate 26 or the substrate 27, whereby the wave pw23 propagating within the propagation region 23*c* is attenuated.

$$\theta = \sin^{-1}(\beta / k_1) \qquad \text{Mathematical Equation 1}$$

$$\theta dc = \sin^{-1}\left\{\sqrt{(\epsilon_r 26/\epsilon_r 23)}\right\} = \sin^{-1}\left\{\sqrt{(\epsilon_r 27/\epsilon_r 23)}\right\} \qquad \text{Mathematical Equation 2}$$

The propagation constant k is determined by the frequency of the planar electromagnetic wave pw23 and the specific permittivity $\in_r$23 of the dielectric substrate 23. The phase constant β is, on the other hand, defined by the frequency of the electromagnetic wave pw23, and the specific permittivity $\in_r$23 and the thickness t of the dielectric substrate 23. It will now be assumed that x, y and z axes be determined, as illustrated in FIG. 2, and that a TE wave travels along the z axis while having the fixed y component of an electric field Ey. The propagation constant $k_1$ of the planar wave propagating through the dielectric substrate 23 can be expressed by the following mathematical equation 3 utilizing the specific permittivity $\in_r$23 of the dielectric substrate 23. Similarly, the propagation constant $k_2$ of the planar wave propagating through the dielectric substrate 26 can be expressed by the following mathematical equation 4 utilizing the specific permittivity $\in_r$26 of the dielectric substrate 26:

$$k_1 = k_0\sqrt{(\in_r 23)} \qquad \text{Mathematical equation 3}$$

$$k_2 = k_0\sqrt{(\in_r 26)} \qquad \text{Mathematical equation 4}$$

wherein $k_0$ represents the propagation constant of the planar wave in a vacuum. Further, since the phase constant β of the planar wave propagating in the dielectric substrate 23 is equal to that in the dielectric substrate 26, the following mathematical equation 5 can hold true:

$$\beta^2 = k_1^2 - kx_1^2 = k_2^2 - kx_2^2 \qquad \text{Mathematical equation 5}$$

wherein $kx_1$ and $kx_2$ respectively indicate x components of the propagation constants $k_1$ and $k_2$ of the planar waves propagating through the dielectric substrates 23 and 26. The relationship between the propagation constants $kx_1$ and $kx_2$ can be expressed by the following mathematical equation 6:

$$(1/kx_1)\tan\{(kx_1\cdot(t23/2)\} - (1/kx_2)\tan(kx_2\cdot t26) = 0 \qquad \text{Mathematical equation 6}$$

Equations 5 and 6 are solved to obtain the propagation constants $kx_1$ and $kx_2$ and the phase constant β.

The angle of incidence θ becomes smaller in response to a decrease in the frequency of the planar electromagnetic wave pw23, and becomes larger according to an increase in the frequency of the wave pw23. Hence, the electromagnetic wave pw23 having a frequency not lower than the critical frequency fda at which the angle of incidence θ is equivalent to the critical angle θdc propagates through the dielectric substrate 23 while repeating the total reflection on the top surface of the dielectric substrate 23 adjacent to the slot 24 and on the bottom surface of the substrate 23 in the vicinity of the slot 25. Namely, the specific permittivity $\in_r$23 and the thickness t23 of the dielectric substrate 23 and the specific permittivity $\in_r$26 and $\in_r$27 of the substrates 26 and 27, respectively, are set so that a desired propagation frequency fb can be not lower than the critical frequency fda. In other words, the specific permittivity $\in_r$23 and the thickness t23 of the dielectric substrate 23 and the specific permittivity $\in_r$26 and $\in_r$27 of the substrates 26 and 27, respectively, are set so that a planar wave having a desired propagation frequency fb can be totally reflected on the top surface of the dielectric substrate 23 adjacent to the slot 24 and on the bottom surface of the substrate 23 close to the slot 25.

The electrodes 21*a* and 22*a*, formed opposedly facing each other while clamping the dielectric substrate 23 therebetween, constitutes a plane-parallel waveguide having a cut-off frequency sufficiently higher than a desired propagation frequency fb with respect to the TE wave. This forms a TE-wave cut-off region 23*a* in part of the dielectric substrate 23 in the widthwise direction. Likewise, the electrodes 21*b* and 22*b*, disposed opposedly facing each other while clamping the dielectric substrate 23 therebetween, serve as a plane-parallel waveguide having a cut-off frequency adequately higher than a desired propagation frequency fb with respect to the TE wave. This forms a TE-wave cut-off region 23*b* along the width of the dielectric substrate 23 in a position opposite to the cut-off region 23*a*.

Further, the electrode 21*a* and the portion of the electrode 28 facing each other constitute a plane-parallel waveguide while clamping the dielectric substrate 26. The thickness t26 of the substrate 26 is set so that the cut-off frequency with respect to the TE wave passing through the plane-parallel waveguide can become higher than a desired propagation frequency fb to a sufficient degree. With this arrangement, a TE-wave cut-off region 26*a* is formed in part of the dielectric substrate 26. Similarly, the electrode 21*b* and the portion of the electrode 28 facing each other constitute a plane-parallel waveguide while clamping the dielectric substrate 26. A TE-wave cut-off region 26*b* is thus formed in the dielectric substrate 26 in a position opposite to the cut-off region 26*a*. Moreover, a plane-parallel waveguide is defined by the electrode 22*a* and the portion of the electrode 29 opposedly facing each other which clamping the dielectric substrate 27. The thickness t27 of the dielectric substrate 27 is set so that the TE-wave cut-off frequency of the plane-parallel waveguide can become higher than a desired propagation frequency fb to a sufficient degree. This forms a TE-wave cut-off region 27*a* in part of the dielectric substrate 27 interposed between the electrode 22*a* and the electrode 29. Likewise, a TE-wave cut-off region 27*b* is formed in the dielectric substrate 27, interposed between the electrode 22*b* and the electrode 29 opposedly facing each other, in a position opposite to the cut-off region 27*a*.

In the planar dielectric line LN10 of the first embodiment constructed as described above, a propagation region 23*c* is defined in which a high-frequency signal having a frequency not lower than the critical frequency fda repeats total reflection alternately on the top surface of the dielectric substrate 23 adjacent to the slot 24 and on the bottom surface of the substrate 23 near the slot 25. The cut-off regions 23*a*, 23*b*, 26*a*, 26*b*, 27*a* and 27*b* are, on the other hand, formed to attenuate the high-frequency signal. With this configuration of the line LN10, a TE wave having a frequency not lower than the critical frequency fda propagates through the dielectric substrate 23 of the dielectric line LN10 in the longitudinal direction while concentrating its electromagnetic-field energy inside and in the vicinity of the propagation region 23*c*.

Also, since the planar dielectric line LN10 comprises the dielectric substrates 23, 26 and 27, it is possible to shorten the wavelengths of electromagnetic waves propagating in the dielectric substrates 23, 26 and 27 than in free space. This further makes it possible to decrease the width and the thickness of the dielectric line LN10 which can thus be made smaller and lighter than square waveguides.

The planar dielectric line LN10 further comprises the electrodes 21*a* and 21*b* mounted on the top surface of the dielectric substrate 23 and electrodes 22*a* and 22*b* on the bottom surface thereof. The widths W of the slots 24 and 25 are set narrower so that other types of electronic parts, such as ICs or the like, can be directly connected to the electrodes 21*a* and 21*b* or the electrodes 22*a* and 22*b*, as implemented in the slotted line of the prior art, thereby enabling easy connection between the planar dielectric line LN10 and the other electronic parts, such as ICs.

Second Embodiment

Figure 12:
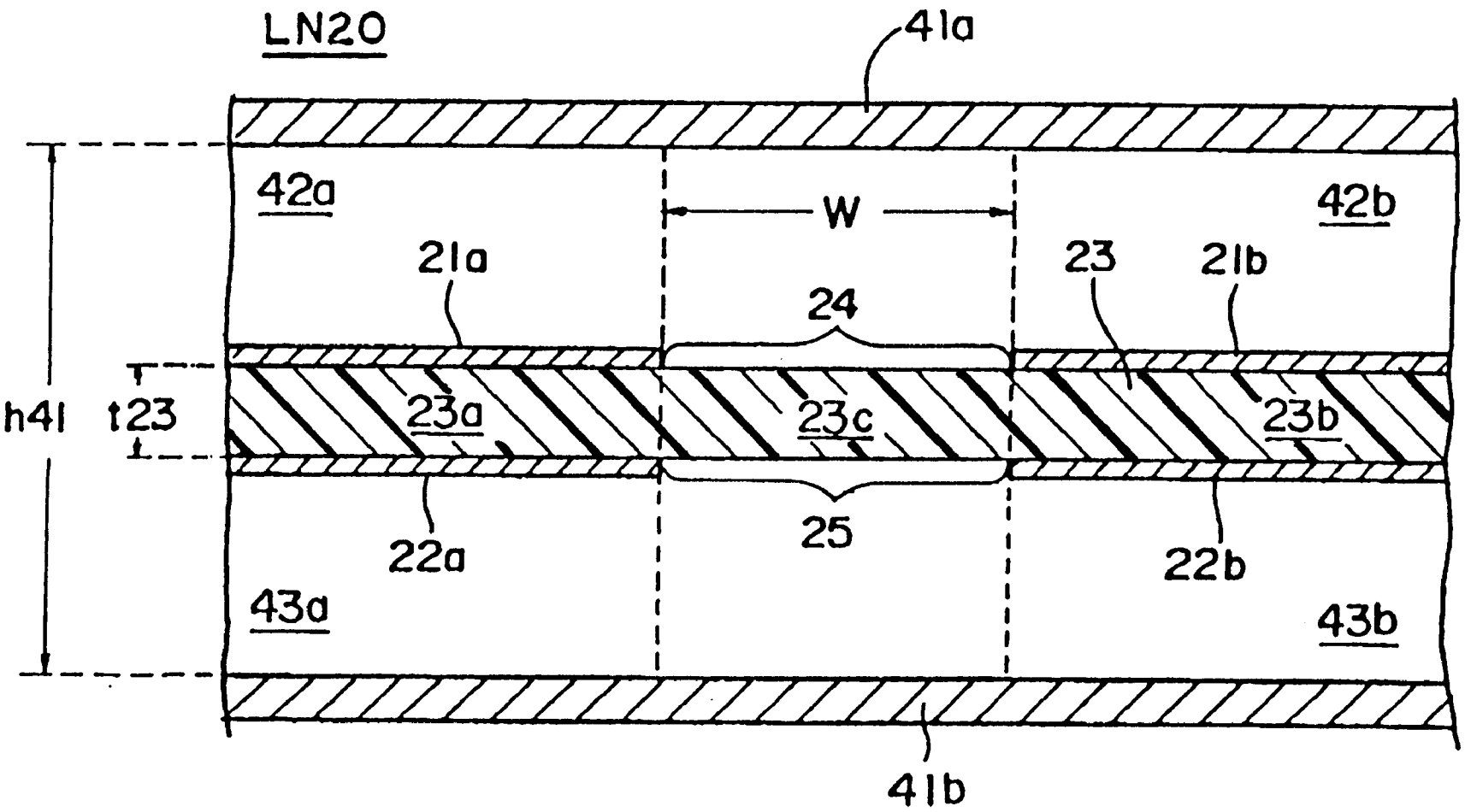
FIG. 12 is a cross sectional view of the dielectric line LN20 according to the second embodiment of the present invention.

FIG. 12 is a cross sectional view of a planar dielectric line LN20 according to a second embodiment of the present invention. The dielectric line LN20 of this embodiment differs from the counterpart of the first embodiment in that upper and lower conductive substrates 41*a* and 41*b* are employed in place of the dielectric substrate 26 provided with the electrode 28 and the dielectric substrate 27 having the electrode 29. Disposed on the top surface of the substrate 23, as well as the dielectric substrate 23 of the first embodiment, are the electrodes 21*a* and 21*b* opposedly facing each other across a predetermined spacing, and the slot 24 is interposed between the electrodes 21*a* and 21*b* in a clamping manner. Also formed on the bottom surface of the dielectric substrate 23 are electrodes 22*a* and 22*b* opposedly facing each other across a predetermined spacing, and the slot 25 is disposed between the electrodes 22*a* and 22*b* in a clamping manner. The upper and lower conductive plates 41*a* and 41*b* are provided in parallel to each other across a predetermined spacing h41. The dielectric substrate 23 provided with the slots 24 and 25 is disposed in parallel to the upper and lower conductive plates 41*a* and 41*b*. The distance between the upper conductive plate 41*a* and the top surface of the substrate 23 is set to be equal to the distance between the lower conductive plate 41*b* and the bottom surface of the substrate 23.

Moreover, in the dielectric line LN20, the specific conductivity $\in_r$23 of the dielectric substrate 23 is determined as follows. The reflection of an electromagnetic wave on the top surface of the substrate 23 adjacent to the slot 24 and on the bottom surface of the substrate 23 in the vicinity of the slot 25 is performed, unlike the first embodiment, in a boundary between the dielectric substrate 23 and free space. The critical angle θc can, therefore, be expressed by the following mathematical equation 7 utilizing the specific permittivity $\in_r=1$ of free space:

$$\theta c=\sin^{-1}\{\sqrt{(1/\in_r 23)}\} \qquad \text{Mathematical equation 7}$$

Accordingly, in the planar dielectric line LN20 of this embodiment, the electromagnetic wave pw23 having a frequency not lower than the critical frequency fa at which the angle of reflection θ becomes equal to the critical angle θc propagates while repeating the total reflection on the top surface of the dielectric substrate 23 near the slot 24 and on the bottom surface of the substrate 23 close to the slot 25. Namely, the specific permittivity $\in_r$23 and the thickness t23 of the substrate 23 are set so that a desired propagation frequency fb can be not lower than the critical frequency fa.

A plane-parallel waveguide is defined by the electrode 21*a* and the upper conductive plate 41*a* opposedly facing each other. The spacing h41 between the upper and lower conductive plates 41*a* and 41*b* is set so that the TE-wave cut-off frequency of the above-mentioned plane-parallel waveguide can be sufficiently higher than a desired propagation frequency fb. A TE-wave cut-off region 42*a* located between the electrode 21*a* and the upper conductive plate 41*a* facing each other is thus formed in part of the free space interposed between the dielectric substrate 23 and the upper conductive plate 41*a*. Likewise, a plane-parallel waveguide is specified by the electrode 21*b* and the upper conductive plate 41*a* facing each other. A TE-wave cut-off region 42*b* clamped between the electrode 21*b* and the upper conductive plate 41*a* is thus formed in free space sandwiched between the substrate 23 and the upper conductive plate 41*a*, in a position opposite to the cut-off region 42*a*.

As described above, the distance between the upper conductive plate 41*a* and the top surface of the dielectric substrate 23 is determined equal to the distance between the lower conductive plate 41*b* and the bottom surface of the substrate 23. Accordingly, a plane-parallel waveguide having a TE-wave cut-off frequency adequately higher than a desired propagation frequency fb is defined by the electrode 22*a* and the lower conductive plate 41*b* opposedly facing each other. A TE-wave cut-off region 43*a* clamped between the electrode 22*a* and the lower conductive plate 41*b* is thus formed in part of the free space interposed between the substrate 23 and the lower conductive plate 41*b*. Similarly, a TE-wave cut-off region 43*b* sandwiched between the electrode 22*b* and the lower conductive plate 41*b* facing each other is thus defined in the free space in a position opposite to the cut-off region 43*a*.

In the planar dielectric line LN20 constructed as described above, a propagation region 23*c* is constructed in which a high-frequency signal having a frequency not lower than the critical frequency fa is transmitted in the dielectric substrate 23 while repeating the total reflection alternately on the top surface of the substrate 23 near the slot 24 and on the bottom surface of the substrate 23 adjacent to the slot 25. The cut-off regions 23*a*, 23*b*, 42*a*, 42*b*, 43*a* and 43*b* are, on the other hand, formed in which the high-frequency signal is attenuated. With this construction, a signal having a frequency not lower than the critical frequency fa propagates in the planar dielectric line LN20 while concentrating its electromagnetic energy inside and in the vicinity of the propagation region 23*c*.

In the second embodiment, the upper and lower conductive plates 41*a* and 41*b* are employed in place of the dielectric substrates 26 and 27 used in the first embodiment. This enhances easier construction of the dielectric line LN20 than the dielectric line LN10 of the first embodiment, which leads to a decrease in costs.

A detailed explanation will now be given of the principle of the operation of the dielectric line LN20 according to the second embodiment. Prior to an explanation of this line LN20, a dielectric-loaded waveguide line LN30 operated similar to the line LN20 will first be described.

Figure 3:
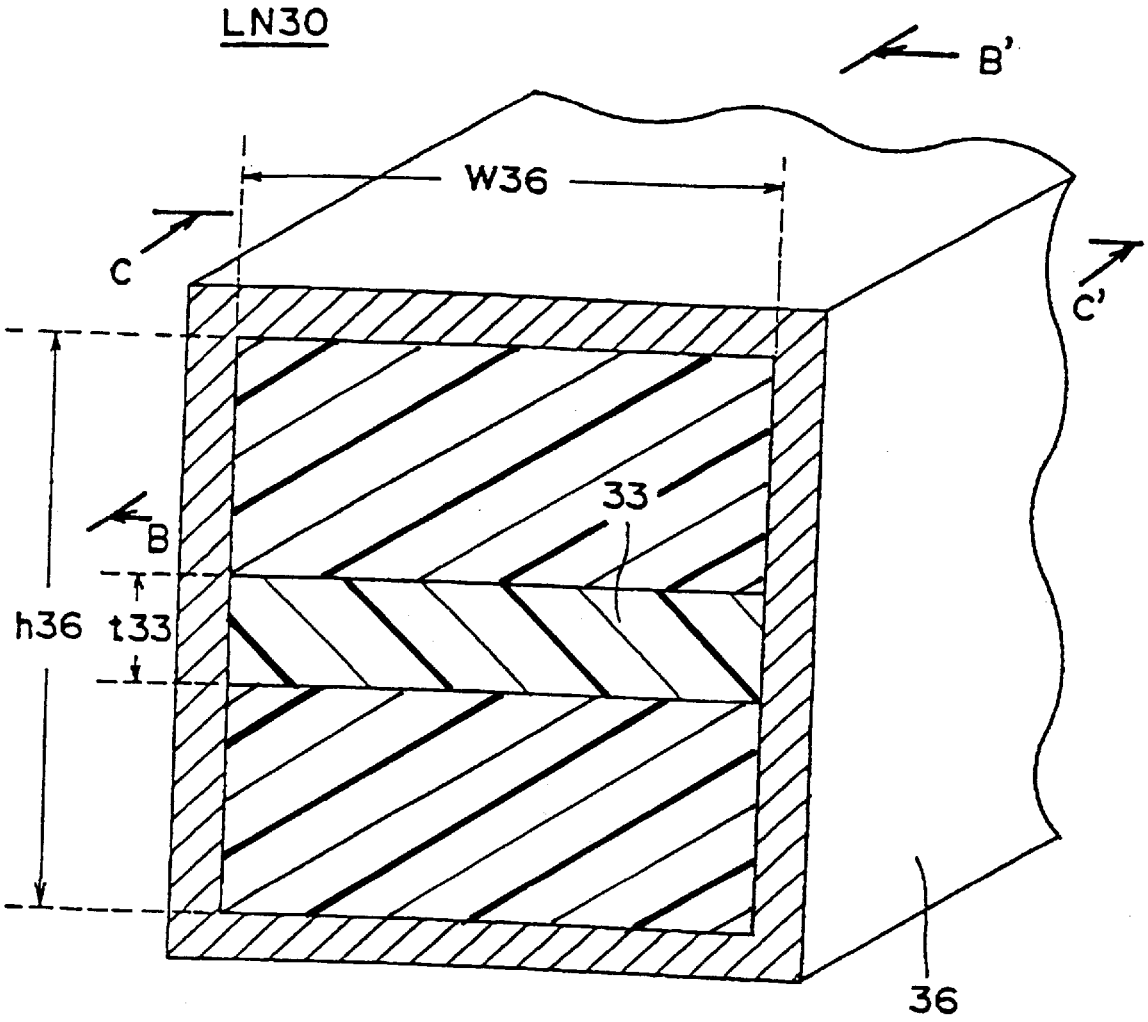
FIG. 3 is a perspective view of a dielectric-loaded waveguide line LN30 used for explaining the operation of the dielectric lines LN10 and LN20 of the first embodiment and the second embodiments, respectively.

The dielectric-loaded waveguide line LN30, as illustrated in FIG. 3, comprises a square waveguide 36 having an internal width W and an internal height h36, and a dielectric substrate 33 having a predetermined thickness t33 and a width equal to the width W of the waveguide 36. The dielectric substrate 33 is disposed at the central portion along the height of the square waveguide 36 so that it can be located in parallel to the upper and lower conductive plates of the waveguide 36. The specific permittivity $\in_r$33 of the dielectric substrate 33 shall be set to equal the specific permittivity $\in_r$23 of the dielectric substrate 23 of the second embodiment.

Figure 4A:
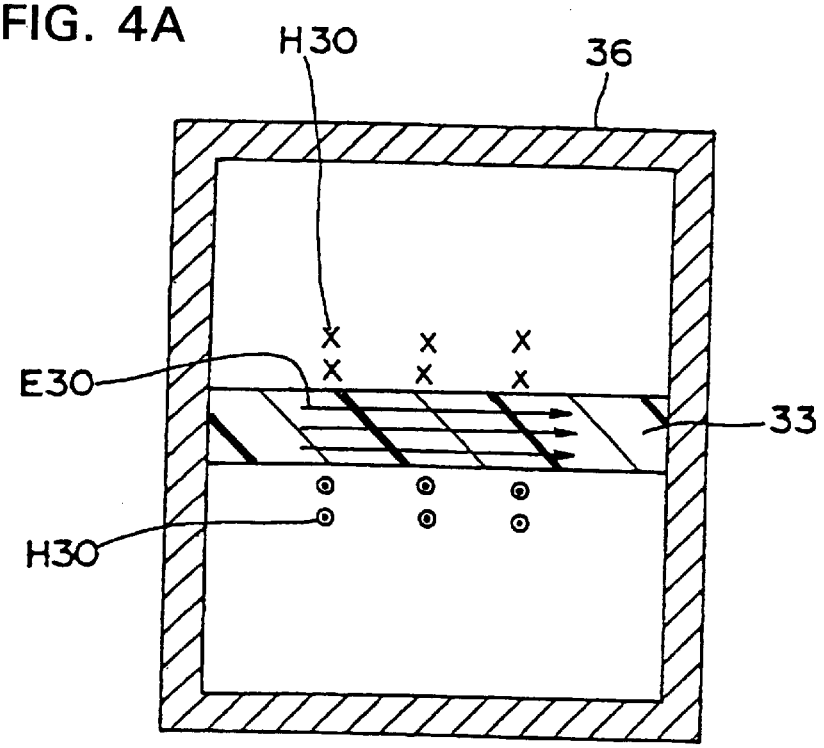
FIG. 4A is a cross sectional view along line C–C' of FIG. 3 illustrating the electromagnetic-field distribution at a frequency not lower than the critical frequency fa at which the angle of incidence θ is equal to the critical angle θc.
Figure 4B:
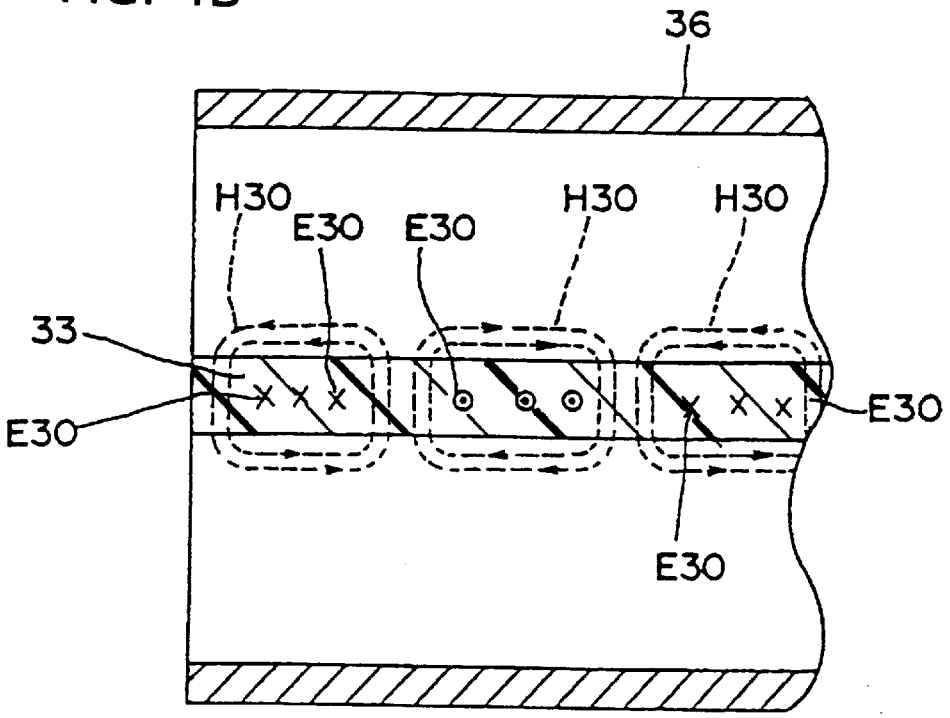
FIG. 4B is a longitudinal sectional view along line B–B' of FIG. 3 illustrating the electromagnetic-field distribution at a frequency not lower than the critical frequency fa.

A high-frequency signal having a frequency not lower than the critical frequency fa is input into the waveguide line LN30 shown in FIG. 3 and is propagated in the substrate 33 in the longitudinal direction while concentrating its electromagnetic energy inside and in the proximity of the substrate 33. The electromagnetic-field distribution obtained during the propagation of the signal in the waveguide 36 is indicated in FIGS. 4A and 4B. FIG. 4A illustrates an electric field E30 and a magnetic field H30 in a cross sectional view along line C–C' of FIG. 3 illustrating the waveguide line LN30. FIG. 4B illustrates the electric field E30 and the magnetic field H30 in a longitudinal sectional view along line B–B' of FIG. 3. FIGS. 4A and 4B clearly show that the electric field E30 and the magnetic field H30 are distributed inside and in the vicinity of the dielectric substrate 33. The electric field E30 has only a component in the widthwise direction of the substrate 33, while the magnetic field H30 has both a component in the longitudinal direction of the substrate 33, i.e., the longitudinal direction of the waveguide 36, and a component perpendicular to the top surface or the bottom surface of the substrate 33.

Figure 11A:
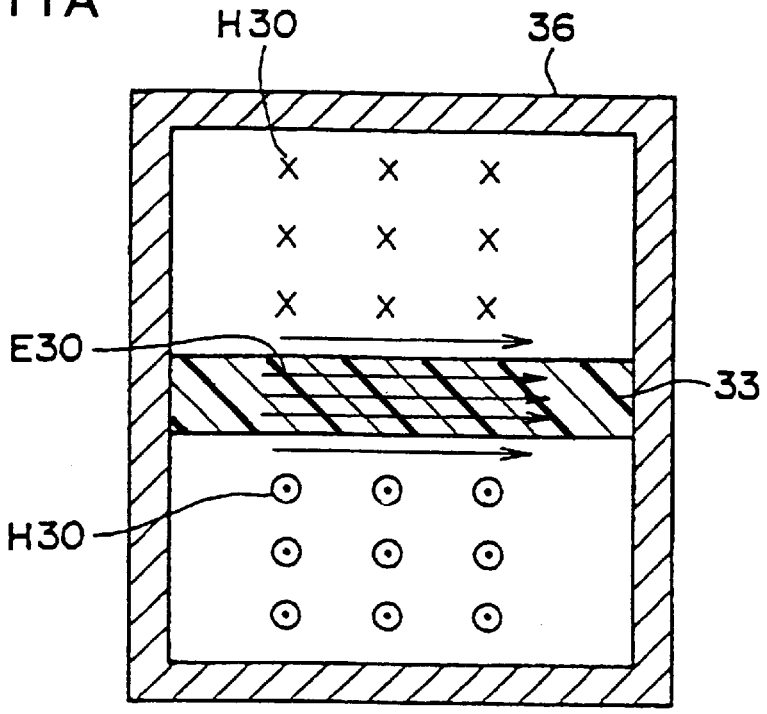
FIG. 11A is a cross sectional view along line C–C' of FIG. 3 illustrating the electromagnetic-field distribution at a frequency not lower than the critical frequency fa.
Figure 11B:
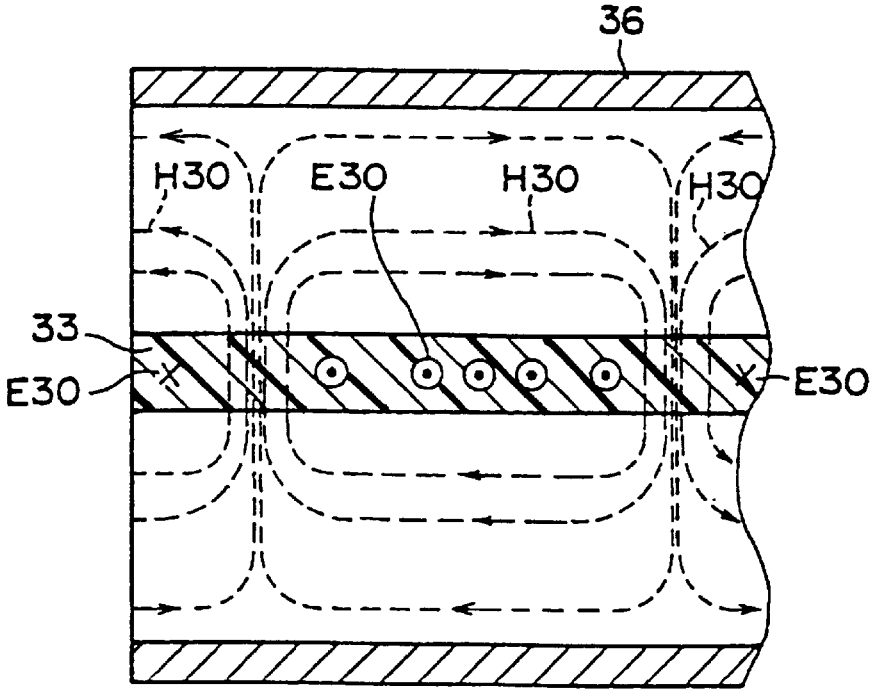
FIG. 11B is a longitudinal sectional view along line B–B' of FIG. 3 illustrating the electromagnetic-field distribution at a frequency not higher than the critical frequency fa.

In contrast, FIG. 11 illustrates an electromagnetic-field distribution obtained when a high-frequency signal having a frequency lower than the critical frequency fa is input into the dielectric-loaded waveguide line LN30. FIG. 11A illustrates the electric field E30 and the magnetic field H30 in a cross sectional view along line C–C' of FIG. 3. FIG. 11B illustrates the electric field E30 and the magnetic field H30 in a longitudinal sectional view along line B–B' of FIG. 3. As is seen from FIGS. 11A and 11B, the magnetic field H30 is distributed farther away from the substrate 33 than the magnetic field of the frequency not lower than the critical frequency fa shown in FIGS. 4A and 4B.

Figure 5:
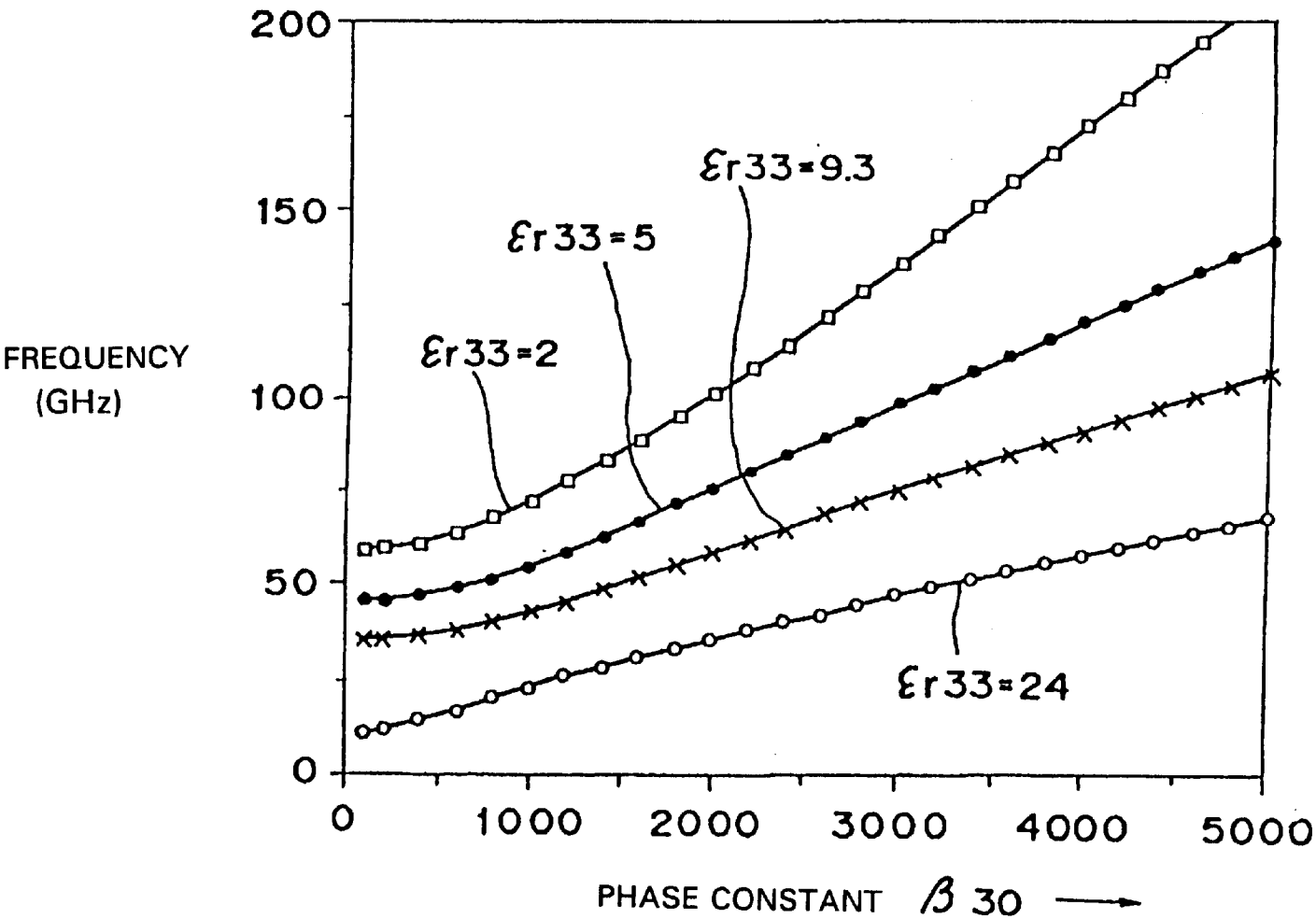
FIG. 5 is a diagram indicating the relationship of the frequency to the phase constant β30 when the specific permittivity $\epsilon_r$33 of a dielectric substrate 33 of the waveguide line LN30 shown in FIG. 3 is varied as the respective values.

FIG. 5 is a diagram indicating the relationship between the frequency and the phase constant β30 of the dielectric-loaded waveguide line LN30 when the specific permittivity $\in_r$33 of the substrate 33 was varied as 2, 5, 9.3 and 24. The values indicated in FIG. 5 were calculated according to mathematical equations 5 and 6. The parameters of the structure of the waveguide line LN30 were set as follows:

(1) The thickness t of the substrate 33=0.33 mm; and (2) The height h of the waveguide 36=2.25 mm FIG. 5 reveals that a higher frequency causes a larger phase constant β30 and that a greater specific permittivity $\in_r$33 gives rise to a larger phase constant β30 under the condition of the same frequency.

Figure 6:
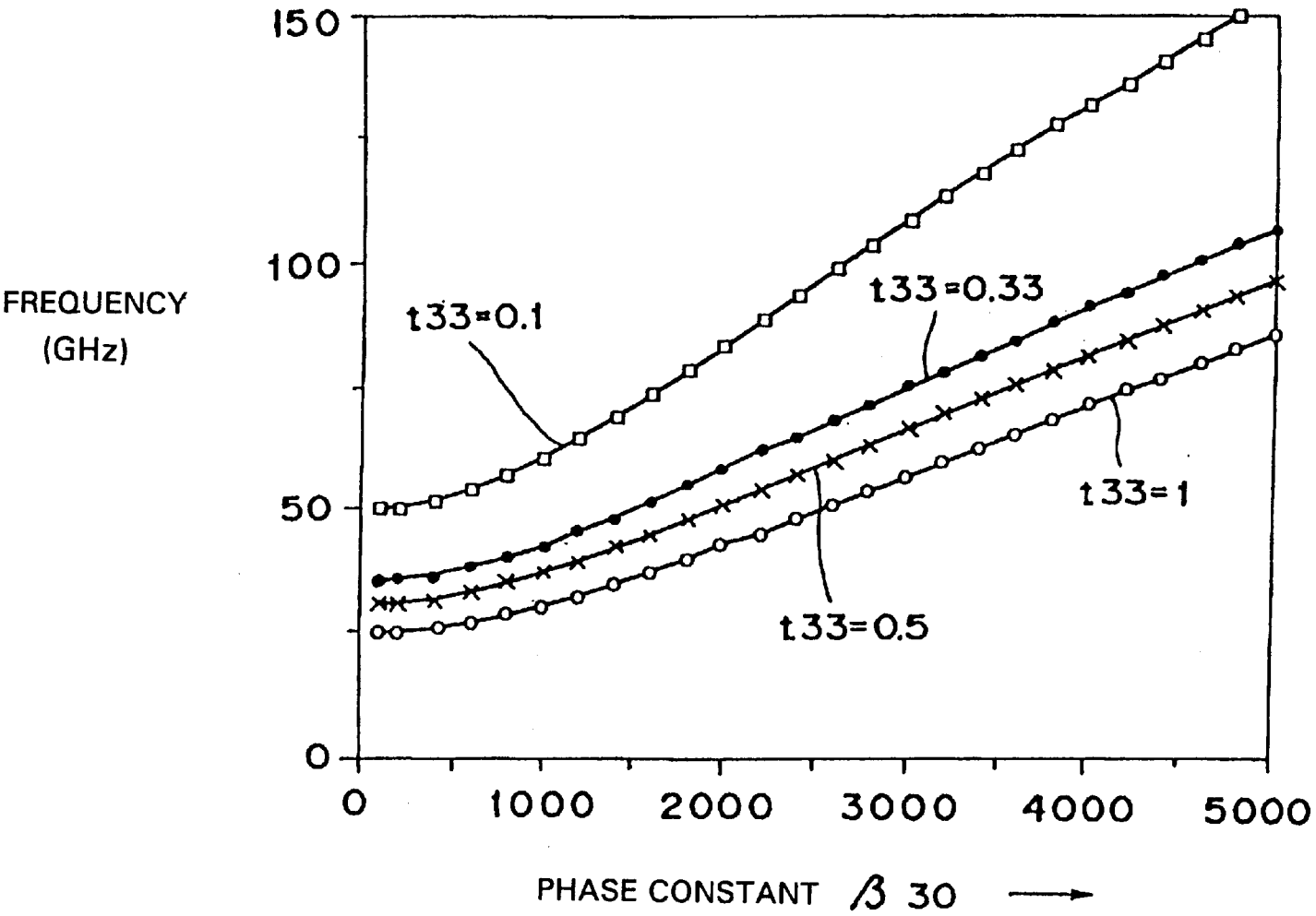
FIG. 6 is a diagram representing the relationship of the frequency to the phase constant β30 when the thickness t33 of the dielectric substrate 33 shown in FIG. 3 is varied as the respective values.

FIG. 6 is a diagram representing the relationship between the frequency and the phase constant β30 of the waveguide line LN30 obtained when the thickness t of the substrate 33 was varied as 0.1 mm, 0.33 mm, 0.5 mm and 1 mm. The values shown in FIG. 6 were calculated according to mathematical equations 5 and 6. The parameters of the structure of the waveguide line LN30 were set as follows:

(1) The specific permittivity $\in_r$33 of the substrate=9.3; and (2) The internal height h of the waveguide 36=2.25 mm FIG. 6 demonstrates that a greater thickness t33 of the substrate 33 causes a greater phase constant β30 under the condition of the same frequency.

Figure 7:
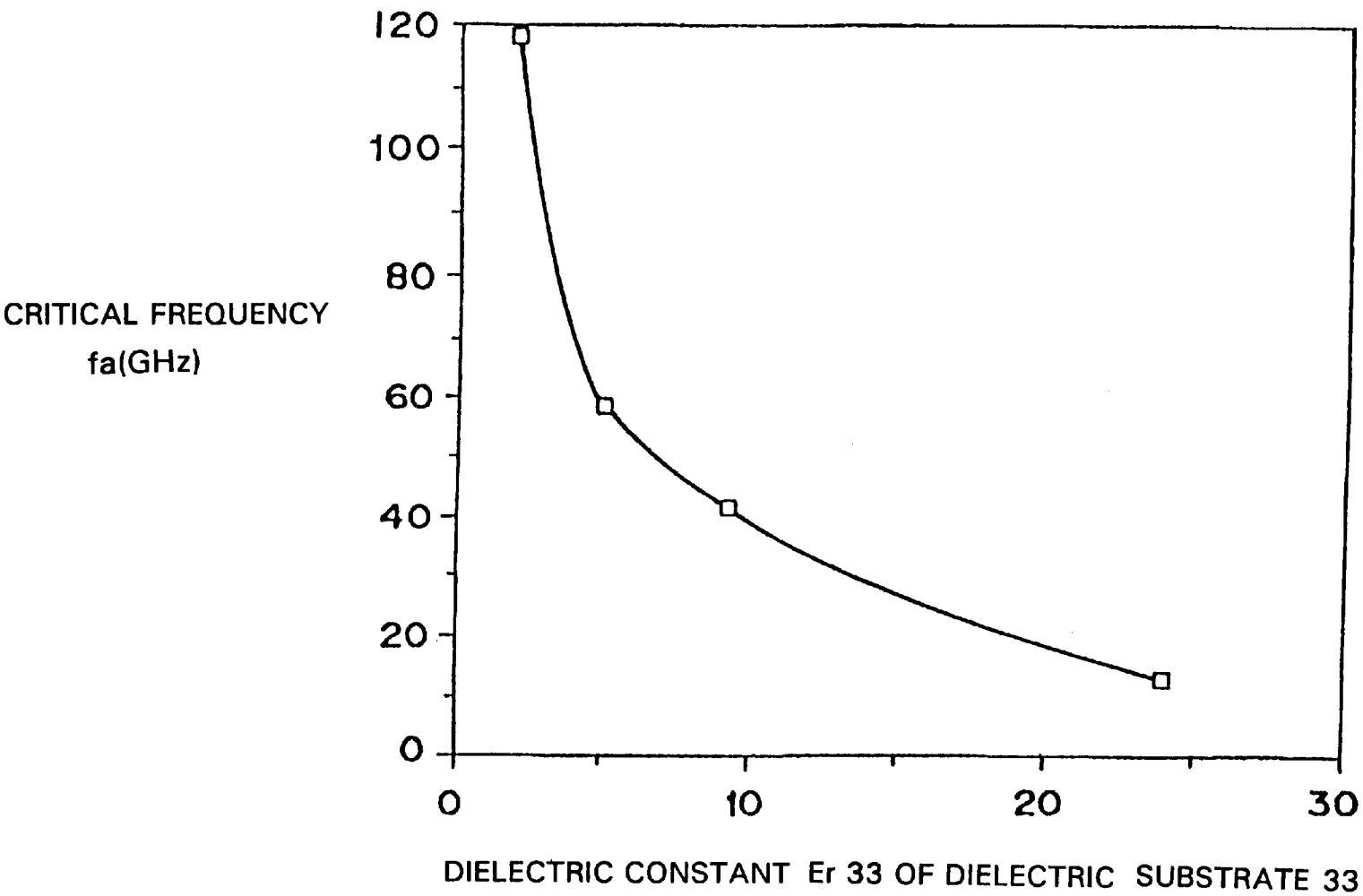
FIG. 7 is a diagram designating the relationship of the critical frequency fa to the specific permittivity $\epsilon_r$33 of the dielectric substrate 33 of the dielectric-loaded waveguide line LN30.

Subsequently, the critical frequency fa at which the angle of incidence θ is equal to the critical angle θc will be calculated with the use of the dielectric-loaded waveguide line LN30. FIG. 7 is a diagram indicating the relationship between the critical frequency fa at which the angle of incidence θ is equal to the critical angle θc and the specific permittivity $\in_r$33 of the substrate 33. The parameters of the structure of the waveguide line LN30 were set as follows:

(1) The thickness t33 of the substrate 33=0.33 mm;

(2) The internal width W36 of the waveguide 36=2.0 mm; and (3) The internal height h36 of the waveguide 36=2.25 mm.

As is seen from FIG. 7, a greater specific permittivity $\in_r$33 of the substrate 33 brings about a lower critical frequency fa. Namely, the dielectric substrate 33 having a higher specific permittivity $\in_r$33 can be used to reduce the minimum propagation frequency fb of a totally-reflecting high-frequency signal to a lower level.

Figure 8:
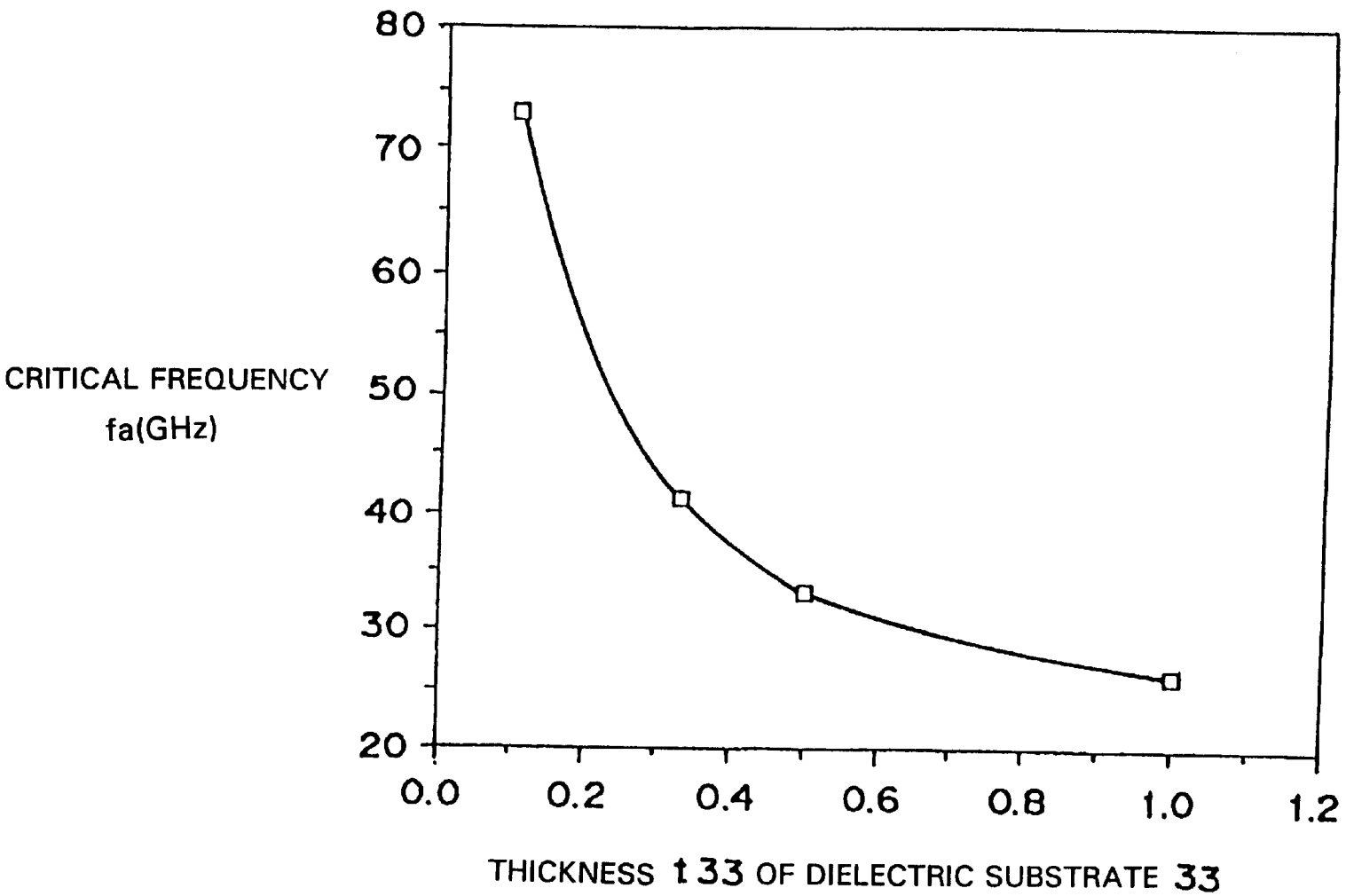
FIG. 8 is a diagram indicating the relationship of the critical frequency fa to the thickness t33 of the dielectric substrate 33 of the dielectric-loaded waveguide line LN30.

FIG. 8 is a diagram representing the relationship between the critical frequency fa at which the angle of incidence θ is equal to the critical angle θc and the thickness t33 of the substrate 33. The parameters of the structure of the waveguide line LN30 were set as follows:

(1) The specific permittivity $\in_r$33 of the substrate 33=9.3;

(2) The internal width W of the waveguide 36=2.0 mm; and (3) The internal height h of the waveguide 36=2.25 mm.

FIG. 8 reveals that a greater thickness t33 of the substrate 33 causes a lower critical frequency fa at which the angle of incidence θ is equal to the critical angle θc. That is, the thickness t33 of the substrate 33 can be set greater to reduce the minimum propagation frequency fb of a totally reflecting high-frequency signal to a lower level.

Based on the operation principle of the waveguide line LN30 explained above, the operation of the planar dielectric line LN20 of the second embodiment will now be described. The critical frequency fa of the dielectric line LN20 was calculated from the critical frequency fa of the dielectric line LN30 when the parameters of the line LN20 were set as follows:

(1) The thickness t23 of the substrate 23=0.33 mm;

(2) The width W20 of the substrate 23=8 mm; and (3) The widths W of the slots 24 and 25=2 mm.

The specific permittivity $\in_r$23 and the thickness t23 of the substrate 23 are respectively set equal to the specific permittivity $\in_r$33 and the thickness t33 of the substrate 33. Also, the widths W of the slots 24 and 25 of the substrate 23 are set equal to the internal width W of the waveguide 36. The spacing h41 between the upper and lower conductive plates 41*a* and 41*b* is set equivalent to the internal height h36 of the waveguide 36.

Figure 9:
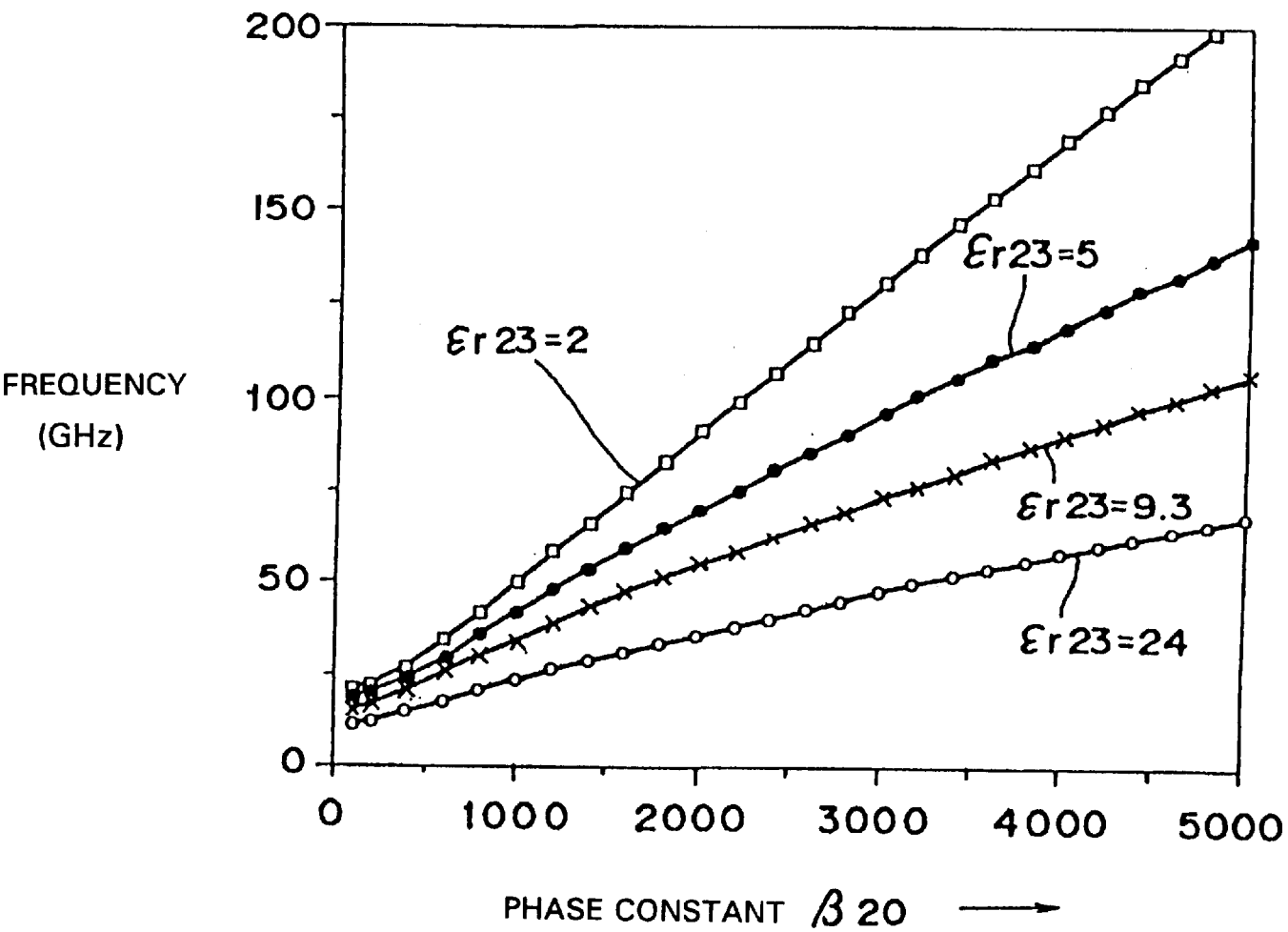
FIG. 9 is a diagram showing the relationship of the frequency to the phase constant β20 when the specific permittivity $\in_r$23 of the dielectric substrate 23 of the dielectric line LN20 of the second embodiment is varied as the respective values.

FIG. 9 is a diagram designating the relationship between the frequency and the phase constant β20 of the dielectric line LN20 when the specific permittivity $\in_r$23 of the substrate 23 was varied as 2, 5, 9.3 and 24. The values shown in FIG. 9 were calculated according to the finite-element method. FIG. 9 demonstrates that a higher frequency gives rise to a greater phase constant β20 and a greater specific permittivity $\in_r$23 brings about a greater phase constant β20 under the condition of the same frequency.

Figure 10:
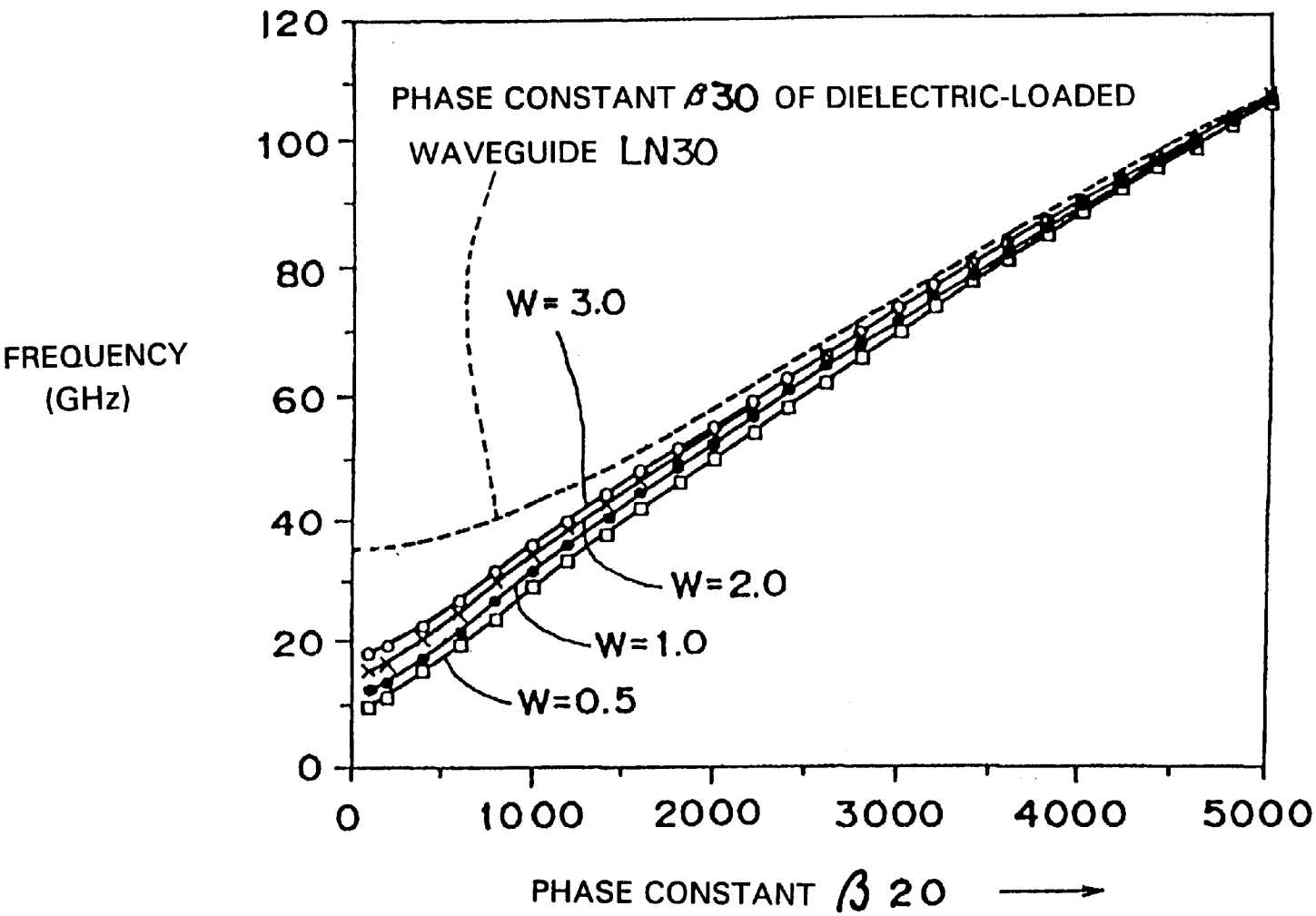
FIG. 10 is a diagram indicating the relationship of the frequency to the phase constant β20 when the width W of the slots 24 and 25 of the dielectric line LN20 was varied as the respective values.

FIG. 10 is a diagram indicating the relationship between the frequency and the phase constant β20 of the dielectric line LN20 when the widths W of the slots 24 and 25 of the substrate 23 were varied as 0.5 mm, 1 mm, 2 mm and 3 mm. The values shown in FIG. 10 were calculated according to the finite-element method. The parameters of the structure of the dielectric line LN20 were set as follows:

(1) The specific permittivity $\in_r$23 of the substrate 23=9.3;

(2) The width W20 of the substrate 23=8 mm; and (3) The spacing h41 between the upper and lower conductive plates 41*a* and 41*b*=2.25 mm.

FIG. 10 shows that a greater width W of the slots 24 and 25 causes a smaller phase constant β20 under the condition of the same frequency.

Figure 13:
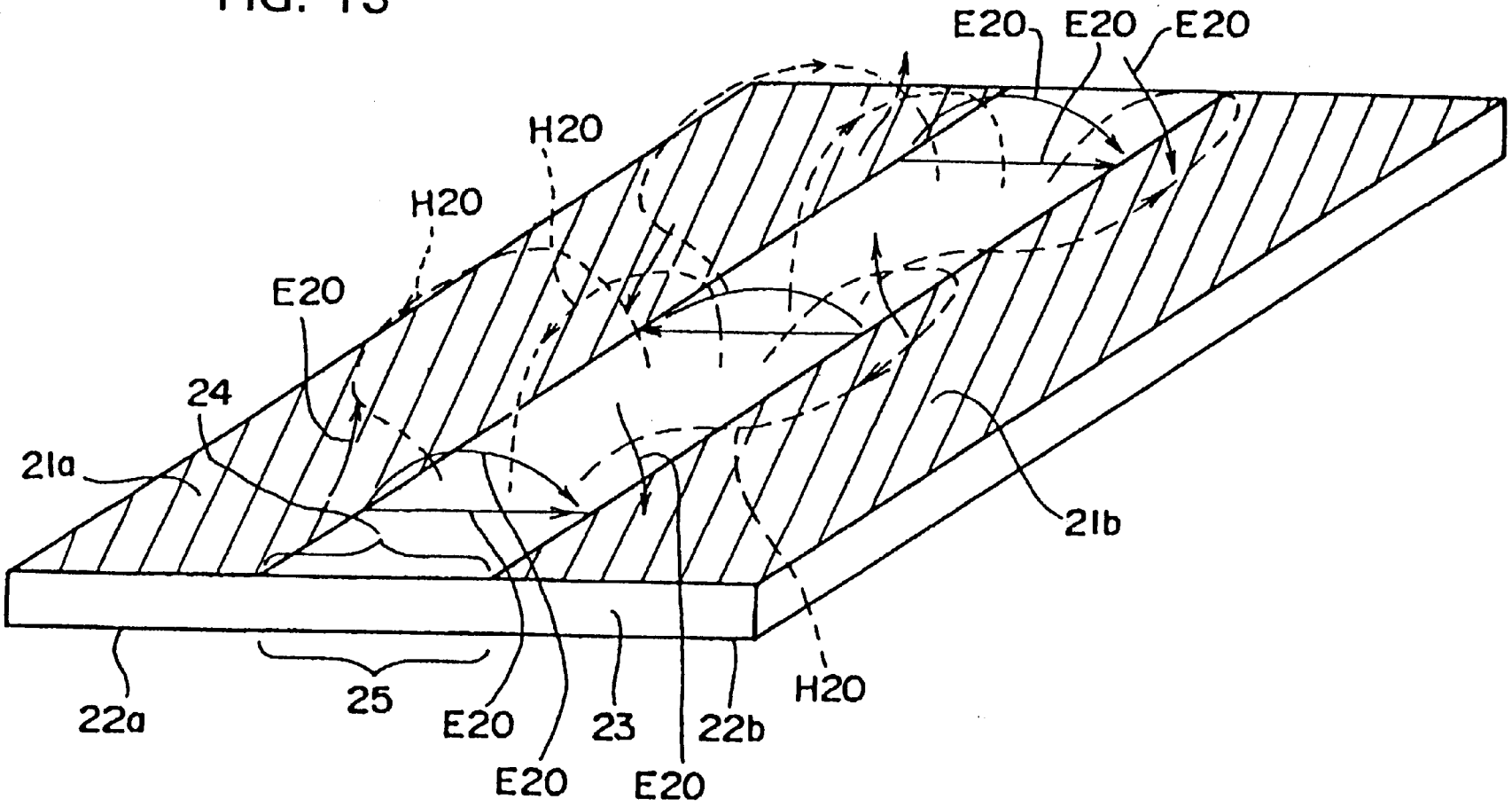
FIG. 13 is a perspective view of a dielectric substrate 23 illustrating the electromagnetic-field distribution at a frequency not higher than the critical frequency fa of the dielectric line LN20 of the second embodiment.

An explanation will further be given of the electromagnetic-field distribution of the dielectric line LN20 according to the second embodiment. FIG. 13 illustrates the electromagnetic-field distribution in a perspective view of the dielectric substrate 23 as a comparative example when a high-frequency signal having a frequency lower than the critical frequency fa is input into the dielectric line LN20. In FIG. 13, the upper and lower conductive plates 41*a* and 41*b* are omitted and only the dielectric substrate 23 is shown. Also in the perspective view of FIG. 13, the top portions of the electrodes 21*a* and 21*b* are hatched for easy differentiation. As is clearly seen from FIG. 13, both the electric field E20 and the magnetic field H20 are distributed farther away from inside and in the vicinity of the substrate 23 than the electromagnetic-field distribution achieved at a frequency not lower than the critical frequency fa, as shown in FIG. 14.

Figure 14:
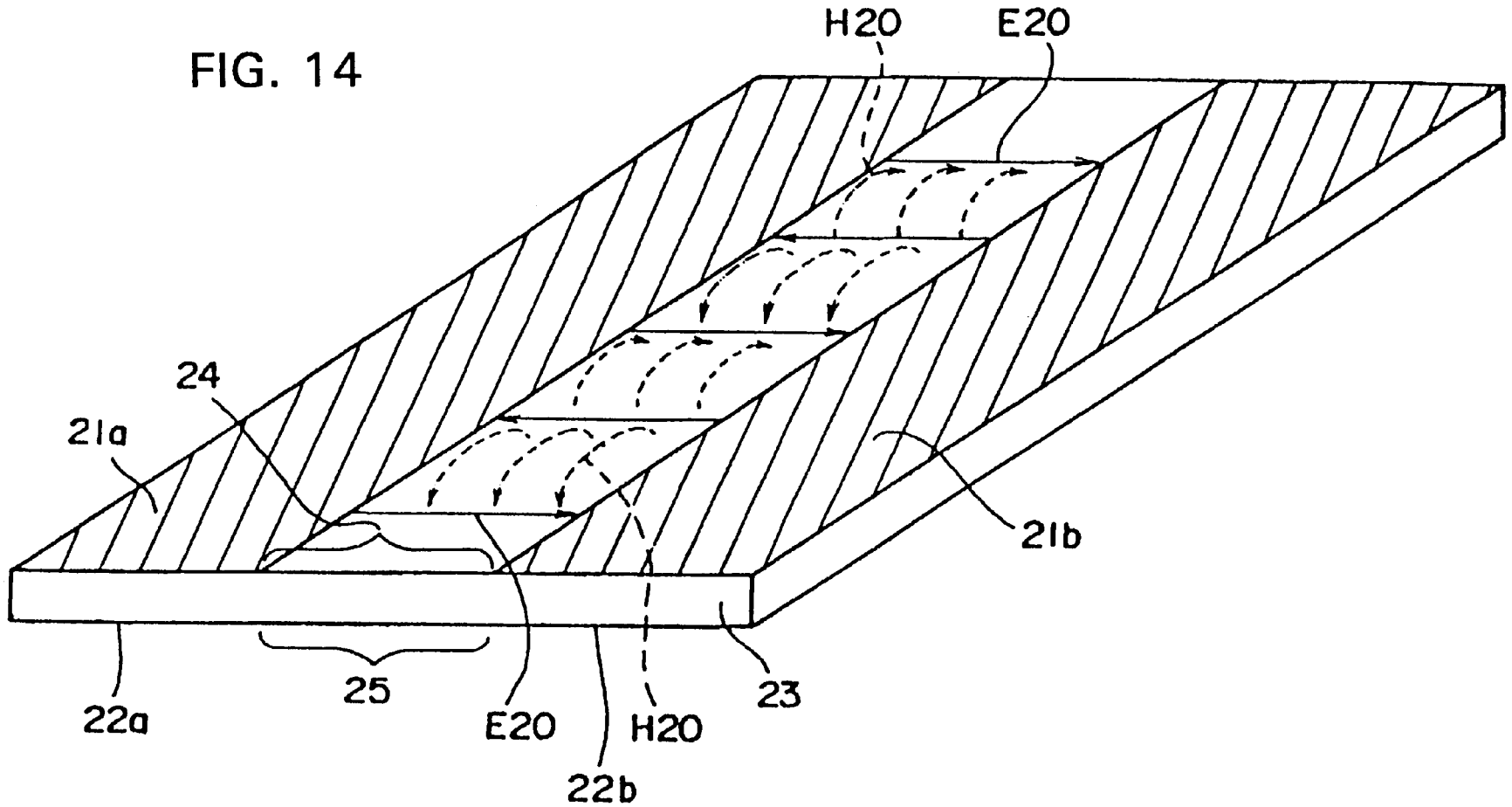
FIG. 14 is a perspective view of the dielectric substrate 23 illustrating the electromagnetic-field distribution at a frequency not lower than the critical frequency fa of the dielectric line LN20 of the second embodiment.

FIG. 14 illustrates the electromagnetic distribution when a high-frequency signal having a frequency not lower than the critical frequency fa is input into the dielectric line LN20. In FIG. 14, as well as FIG. 13, the upper and lower conductive plates 41*a* and 41*b* are omitted and only the substrate 23 is shown. Also, in the perspective view of FIG. 14, the top surfaces of the electrodes 21*a* and 21*b* are hatched for easy differentiation. FIG. 14 reveals that both the electric field E20 and the magnetic field H20 are concentrated only inside and in the proximity of the propagation region 23*c* of the substrate 23*d*. More specifically, it is seen that a high-frequency signal having a frequency not lower than the critical frequency fa is totally reflected on the top surface of the substrate 23 adjacent to the slot 24 and on the bottom surface of the substrate 23 in the vicinity of the slot 25.

Although only the operation of the dielectric line L20 has been discussed above, the dielectric line LN10 of the first embodiment is operated in a manner similar to the line LN20. As has been described above in detail, both the planar dielectric line LN10 of the first embodiment and the line LN20 of the second embodiment are operated in a manner similar to the dielectric-loaded waveguide line LN30 and used for transmitting a high-frequency signal having a frequency not lower than the critical frequency fa.

Figure 15:
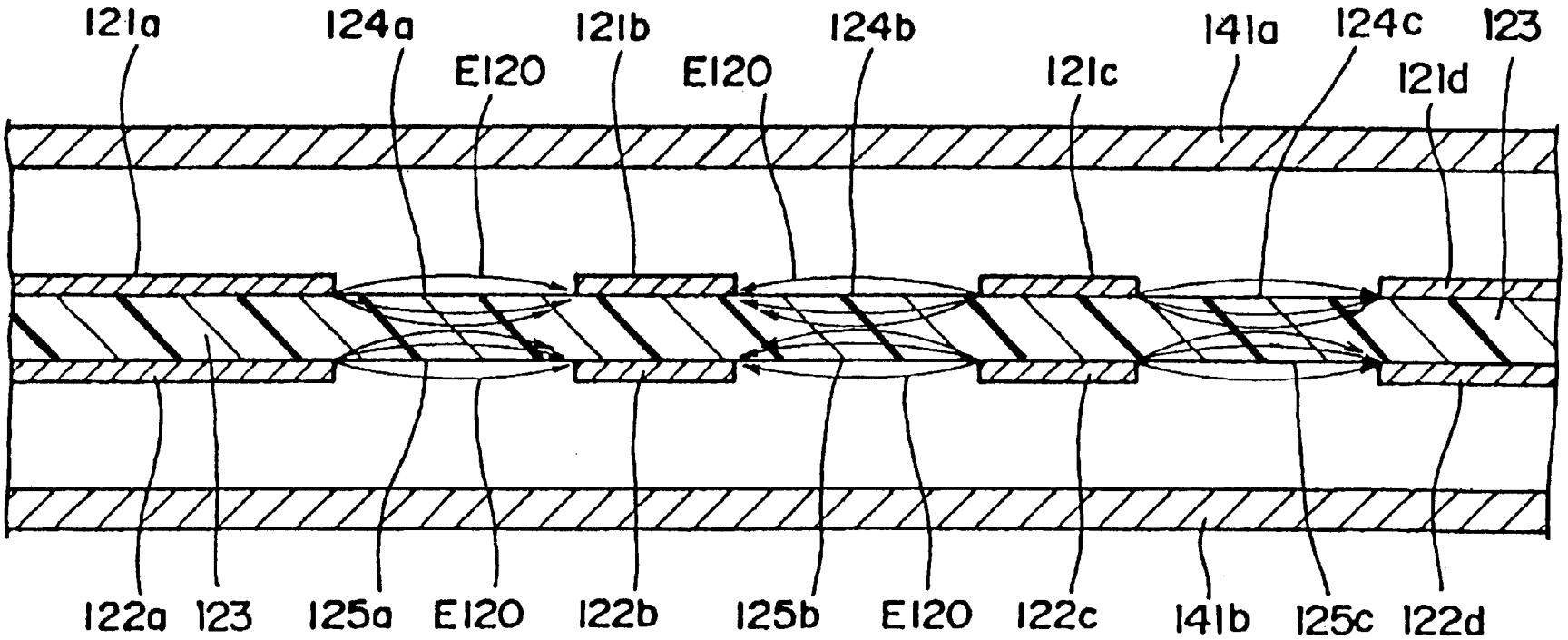
FIG. 15 is a cross sectional view of two planar dielectric lines of the second embodiment illustrating the electric-field distribution at a frequency not lower than the critical frequency fa when the planar dielectric lines are disposed in proximity to each other.

The present inventors observed the electric-field distribution by use of the model shown in FIG. 15 in order to examine the operation performed when two or more planar dielectric lines are disposed in proximity to each other. The construction of the model and results will be explained. In the model shown in FIG. 15, the electrodes 121*a*, 121*b*, 121*c* and 121*d* and the slots 124*a*, 124*b* and 124*c* are alternately formed on the top surface of the substrate along its width. More specifically, the slot 124*a* is disposed between the electrodes 121*a* and 121*b*; the slot 124*b* is clamped between the electrodes 121*b* and 121*c*; and the slot 124*c* is interposed between the electrodes 121*c* and 121*d*. The slots 124*a*, 124*b* and 124*c* are formed in parallel to the longitudinal direction of the substrate 23 and also have the same widths. The electrodes 121*b* and 121*c* also have the same widths.

Mounted on the bottom surface of the substrate 123 are electrodes 122*a* and 122*b* opposedly facing the electrodes 121*a* and 121*b*, respectively, across the substrate 123. Also, electrodes 122*c* and 122*d* are disposed opposedly facing the electrodes 121*c* and 121*d*, respectively, across the substrate 123. With this arrangement, slots 125*a*, 125*b* and 125*c* are located opposedly facing the slots 124*a*, 124*b* and 124*c*, respectively. The substrate 123 is disposed between the upper and lower conductive plates 141*a* and 141*b* in parallel to each other so that it can be placed in parallel thereto. The distance between the top surface of the substrate 123 and the upper conductive plate 141*a* can equal the bottom surface of the substrate 123 and the lower conductive plate 141*b*. Moreover, the upper and lower conductive plates 141*a* and 141*b* are spaced apart from each other in a manner similar to the second embodiment. The three planar dielectric lines in parallel to each other are thus constructed.

Figure 16:
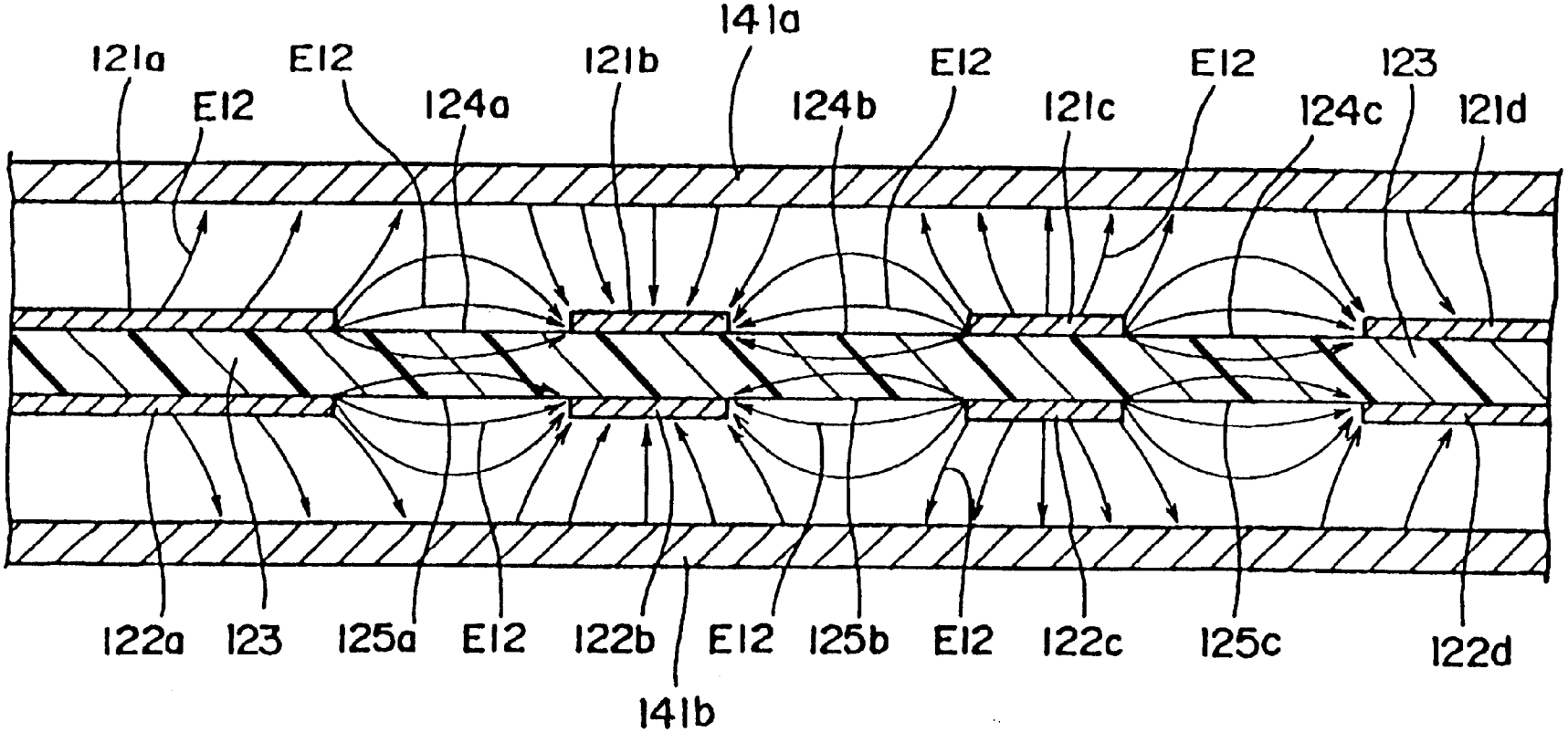
FIG. 16 is a cross sectional view of two planar dielectric lines of the second embodiment illustrating the electric-field distribution at a frequency not higher than the critical frequency fa when the dielectric lines are disposed in proximity to each other.

FIG. 15 illustrates an electric field E120 obtained when high-frequency signals having a frequency not lower than the critical frequency fa are transmitted in the three plane dielectric lines. FIG. 15 shows that the signals are transmitted in the longitudinal direction of the substrate 123 without interfering with each other. FIG. 16 indicates an electric field E12 resulting when high-frequency signals having a frequency lower than the critical frequency fa are transmitted in the three lines. FIG. 16 reveals that high-frequency signals suffer from electromagnetic-field coupling, i.e., electromagnetic-field interference.

As has been discussed above in detail, in the respective planar dielectric lines LN10 and LN20 of the first and second embodiments, a high-frequency signal having a frequency not lower than the critical frequency fa is totally reflected on the top surface of the substrate 23 adjacent to the slot 24 and on the bottom surface of the substrate 23 in the vicinity of the slot 25, whereby the signal can be propagated while concentrating its electromagnetic-field energy inside and in the proximity of the propagation region 23*c* of the substrate 23. To further develop these embodiments, it is possible to dispose a plurality of planar dielectric lines in parallel to each other along the width of the substrate 123, thus enabling the formation of highly-integrated circuits.

Figure 17:
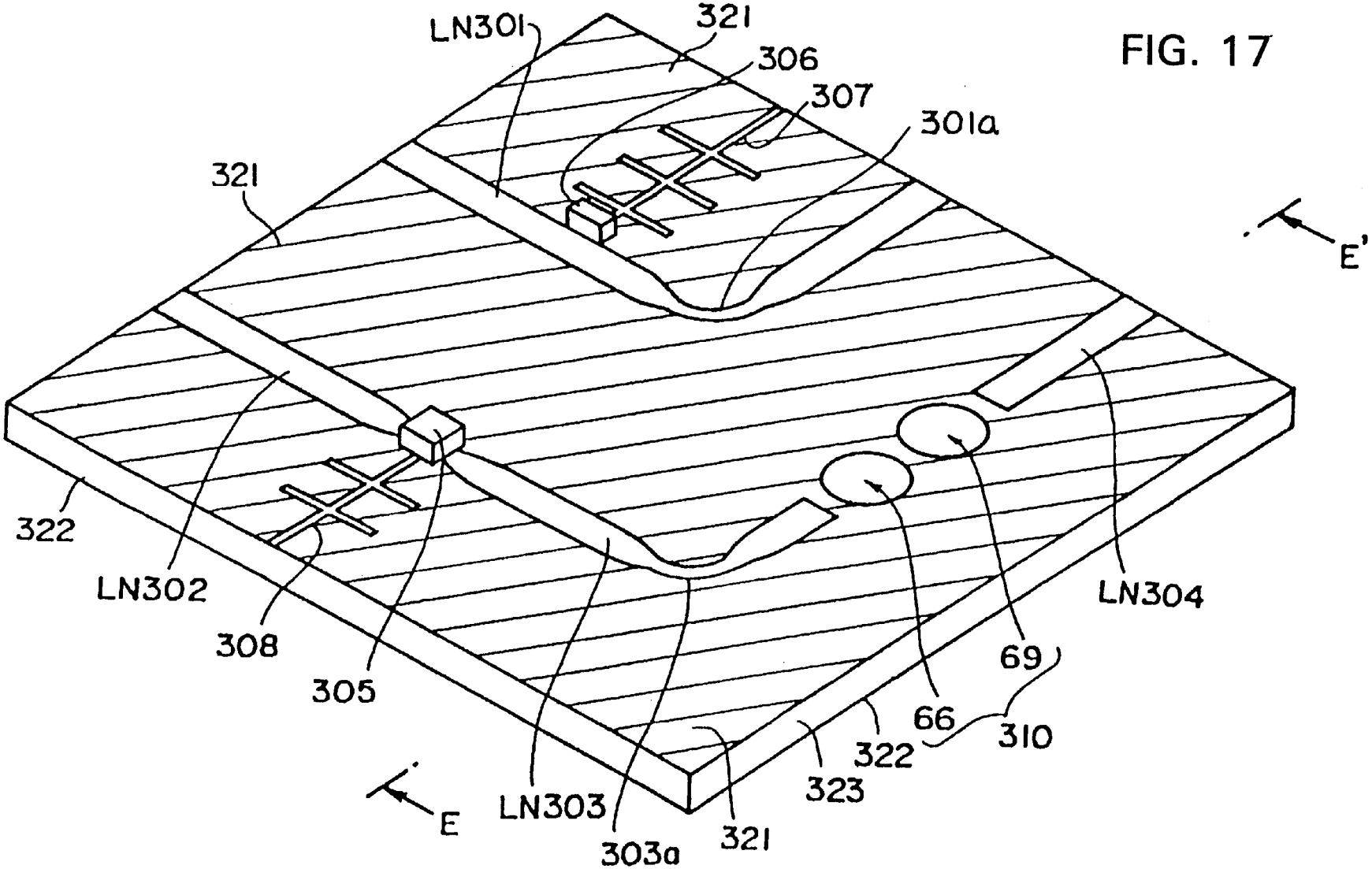
FIG. 17 is a perspective view of an example of applications of the dielectric lines according to the present invention.

FIG. 17 is a perspective view of an integrated circuit produced by the application of the planar dielectric line according to the present invention. This integrated circuit is configured to have a generally-square dielectric substrate 323 provided with a plurality of dielectric lines. An electrode 321 with a predetermined shape is mounted on the top surface of the substrate 323, while an electrode 322 with a predetermined shape is formed on the bottom surface of the substrate 323, both the electrodes 321 and 322 opposedly facing each other. Accordingly, planar dielectric lines LN301, LN302, LN303 and LN304, a high pass filter 310, and biasing lines 307 and 308 are formed on the dielectric substrate 323. On the top surface of the substrate 323, a circuit part module 305 is connected between the dielectric lines LN302 and LN303, while a circuit part module 306 is connected between the dielectric line LN301 and the biasing line 307. The bent portions of the lines LN301 and LN303 are comprised of line portions 301*a* and 303*a*, respectively, formed by the narrowed slots. This makes it possible to bend the dielectric lines LN301 and LN303 without requiring a change from the propagation mode currently employed in the lines LN301 and LN303 to another mode.

Figure 18:
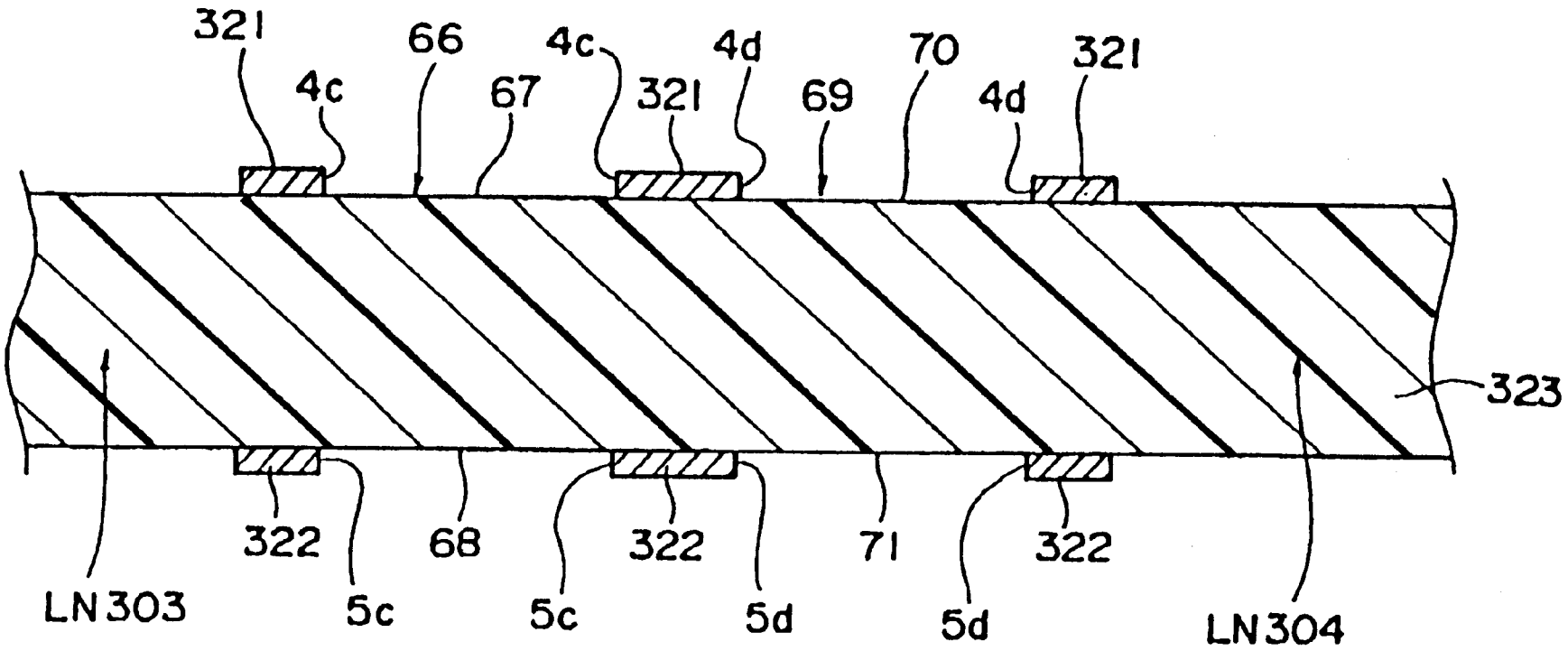
FIG. 18 is a sectional view along line E–E' of FIG. 17.
Figure 19:
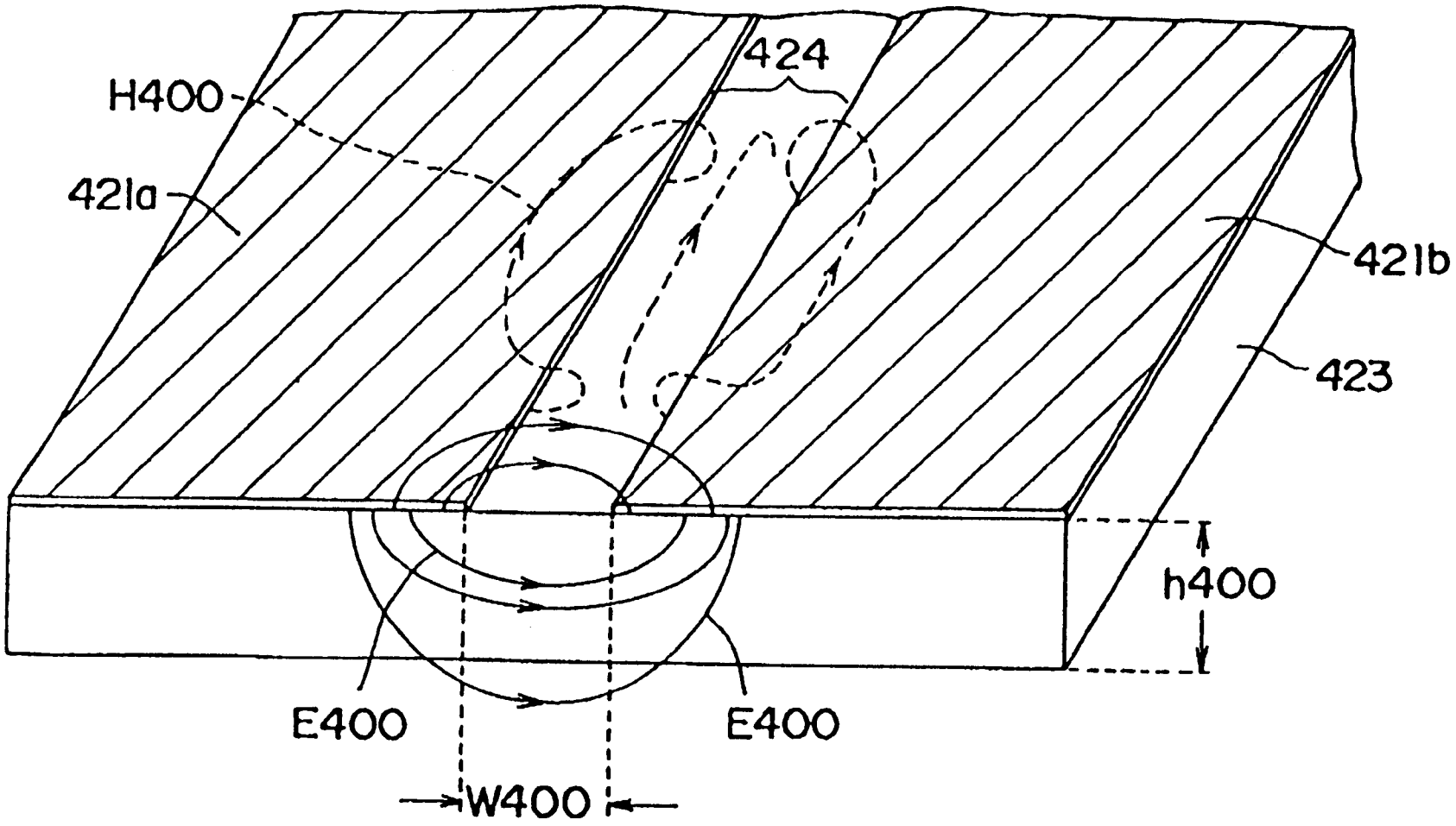
FIG. 19 PRIOR ART
FIG. 19 is a perspective view of a conventional slotted line.

The high pass filter 310 will now be described. FIG. 18 is a sectional view along line E–E' of FIG. 17. As shown in FIGS. 17 and 18, two circular openings 4*c* and 4*d* having the same diameter are formed on the top surface of the substrate 323. On the other hand, two circular openings 5*c* and 5*d* of the same size as the openings 4*c* and 4*d* are formed on the bottom surface of the substrate 323. The openings 4*c* and 4*d* are disposed between the dielectric lines LN303 and LN304 so that they can be located in parallel to each other across a predetermined spacing. Also, the openings 4*d* and 5*d* are coaxially formed to opposedly face each other. With this construction, two cylindrical resonator-forming regions 66 and 69 of the same shape are located between the dielectric lines LN303 and LN304. The resonator-forming region 66, which is part of the substrate 323, is defined as a cylindrical region having the surface 67 of the opening 4*c* adjacent to the substrate 323 and the surface 68 of the opening 5*c* close to the substrate 323. The resonant-forming region 69, on the other hand, which is part of the substrate 323, is defined as a cylindrical region having the surface 70 of the opening 4*d* near the substrate 323 and the surface 71 of the opening 5*d* adjacent to the substrate 323.

The specific permittivity and the thickness of the substrate 323 and the diameters of the openings 4*c*, 4*d*, 5*c* and 5*d* are so determined as to generate a standing wave when the resonant-forming regions 66 and 69 are excited by a high-frequency signal having the same frequency as a desired resonance frequency. Further, a plane-parallel waveguide is formed by electrodes 321 and 322 clamping the portions of the substrate 323 other than the resonator-forming regions 66 and 69 and the propagation regions, i.e., dielectric lines LN301, LN302, LN303 and LN304. The specific permittivity and the thickness of the substrate 323 are also determined so that the cut-off frequency of the plane-parallel waveguide will be higher than a desired resonance frequency. With this arrangement, the resonator-forming region 66 and adjacent free space, and the resonator-forming region 69 and free space in the vicinity thereof, respectively constitute $TE_{010}$ mode-dielectric resonators. The regions 66 and 69 are separated from each other across a predetermined spacing so that the dielectric line LN303 and the $TE_{010}$ mode-dielectric resonator formed by the region 66 can be inductively coupled. The distance between the dielectric line LN304 and the region 69 is determined so that the dielectric line LN304 and the $TE_{010}$ mode-dielectric resonator formed by the region 69 can be inductively coupled.

In this manner, the high pass filter 310 is constructed by the cascade connection of the two $TE_{010}$ mode dielectric resonators between the dielectric lines LN303 and LN304. This causes a high-frequency signal having a predetermined frequency passing through the dielectric line LN303 being transmitted to the line LN304 through the two $TE_{010}$ mode-dielectric resonators.

Examples of modifications of the present invention will now be explained.

The planar dielectric line LN10 of the first embodiment is comprised of the dielectric substrates 26 and 27, while the dielectric line LN20 of the second embodiment is formed with the use of the upper and lower conductive plates 41*a* and 41*b*. However, this is not exclusive, and the dielectric line may use only the dielectric substrate 23 provided with the slots 24 and 25. This modification also makes it possible to operate in a manner similar to the first and second embodiments and offer similar advantages, with a simpler construction.

Although the upper and lower conductive plates 41*a* and 41*b* are used for the dielectric line LN20 of the second embodiment, as described above, the present invention is not limited thereto. Instead, a square waveguide defined by the upper and lower conductive plates 41*a* and 41*b* and lateral-surface conductors may be employed to form the line. With this modification, it is also possible to operate in a manner similar to the first and second embodiments and offer similar advantages.

In the dielectric line LN20 of the second embodiment, the distance between the upper conductive plate 41*a* and the top surface of the substrate 23 is determined to equal the distance between the lower conductive plate 41*b* and the bottom surface of the substrate 23. However, this is not exclusive, and the former distance may differ from the latter distance. The line obtained by the above modification is still operable in a manner similar to the first and second embodiments and can present the similar advantages.

Further, although the specific permittivity $\in_r 26$ of the dielectric substrate 26 is determined to be equal to the specific permittivity $\in_r 27$ of the substrate 27, they may differ from each other.

As will be clearly understood from the foregoing description, the present invention offers the following advantages.

In the planar dielectric line according to a first aspect of the present invention, a first slot having a predetermined width is formed on the first surface of the dielectric substrate, and a second slot is mounted on the second surface of the substrate, both the slots facing each other. This makes it possible to provide a small and inexpensive planar dielectric line that can enhance easier connection with electronic parts, such as ICs, and inhibit conduction losses to a smaller level than microstrip lines, coplanar lines and slotted lines.

The planar dielectric line according to a second aspect of the present invention is constructed by adding first and second conductive plates to the planar dielectric line implemented by the first aspect of the present invention. It is thus possible to prevent leakage of high-frequency signals propagating in the above-described dielectric line to the exterior and also to preclude the entry of high-frequency signals from the exterior of the dielectric line.

In the planar dielectric line according to a third aspect of the present invention, the following features are added to the dielectric line implemented by the second aspect of the present invention. Namely, a dielectric is charged between the first surface of the dielectric substrate and the first conductive plate, and another dielectric is also interposed between the second surface of the substrate and the second conductive plate, each dielectric having a smaller degree of permittivity than the dielectric substrate. The planar dielectric line can thus be made thinner.

An integrated circuit according to a fourth aspect of the present invention comprises a transmission line and a high-frequency device connected to the transmission line. The transmission line includes at least one of the planar dielectric lines implemented by the first to third aspects of the present invention. Accordingly, a highly-integrated circuit can be constructed.

When a planar dielectric line is incorporated in an electronic device used in a microwave or millimeter-wave band, in particular an ultra-small device such as a mobile phone, it is important that the RF transmitting/receiving module is designed and constructed such that the line substrate occupies only a small volume, e.g., 3 to 5 cubic centimeters (cc). In order that this goal is met, it is important that the dielectric line is implemented at a large scale of integration. In such a case, the dielectric lines are laid in close proximity to each other, with a spacing which is sufficiently small as compared with the wavelength corresponding to the frequency at which the device operates, e.g., at a distance which is as small as 0.2 to 0.3 times the wavelength. Such a dense arrangement of the dielectric lines, however, causes inconveniences such as crosstalk due to interference between two adjacent lines, when the dielectric lines are used in a communication module. It is therefore necessary to minimize the leakage of signals from the transmission line. The planar dielectric transmission line, referred to as "PDTL" hereinafter, advantageously meets such a condition. The frequency range at which the PDTL is practically usable is 20 GHz or higher. The present invention is aimed at providing conditions for suppressing unnecessary coupling between two adjacent lines while meeting the goal of greater scale of integration.

Figure 20:
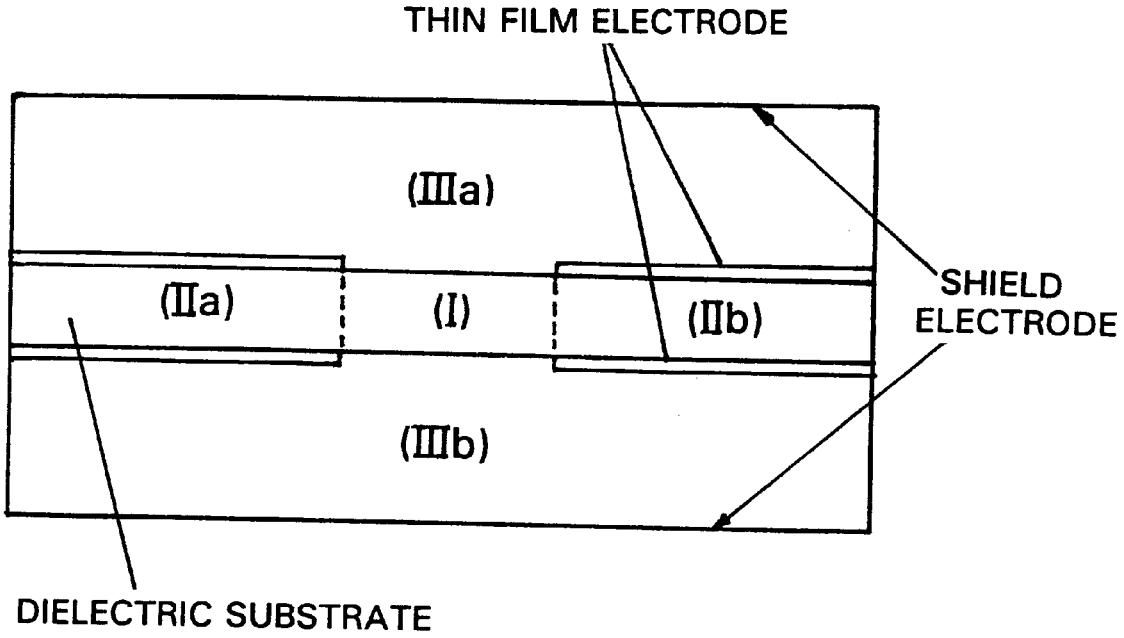
FIG. 20 is a sectional view of a planar dielectric transmission line (PDTL) in accordance with an embodiment of the present invention.

FIG. 20 is a sectional view of a PDTL taken along a plane perpendicular to the direction of propagation. The PDTL has a dielectric substrate having regions I, IIa and IIb, and upper and lower air layers IIIa, IIIb. For the purpose of simplification of explanation, the regions of the dielectric substrate are grouped into two groups: namely, the region I which is inside the line and the region inclusive of IIa and IIb outside the line. Referring to FIG. 20, interference between two adjacent lines takes place at two locations: namely, at the upper and lower air layers IIIa, IIIb and at the region IIa, IIb inside the dielectric substrate. However, since most of the energy is confined in the dielectric body, no substantial parasitic coupling with the exterior takes place. Thus, internal coupling inside the dielectric substrate is the dominant factor of the interference between two adjacent lines.

From a quantitative point of view, if 80% or more of the electric field propagating through a PDTL is confined in one of the two adjacent lines, almost no parasitic coupling, i.e., interference, takes place when the other line is positioned in the close proximity to the first-mentioned line. Interference is further suppressed when 90% or more of the energy is confined.

The pattern of concentration of energy inside the PDTL line can be determined by determining the electromagnetic field distribution inside the cross-section shown in FIG. 1 by the finite-element analytical technique and then processing the electromagnetic field distribution in accordance with the perturbation method.

For reference, the finite-element analytical technique used in determining the electromagnetic field distribution is disclosed in the following theses: "Reference in regard to spurious solution in finite-element analysis using three components of magnetic field in dielectric waveguide", by Koshiba, Hayata and Suzuki, *Theses of the Institute of Electronics, Information and Communication Engineers* (B), J67-B, 12, pp. 1333–1338 (December, 1984); "Removal of spurious solution in finite-element vector analysis of dielectric waveguide-solution by transverse component of magnetic field", by Hayata, Koshiba, Eguchi and Suzuki, *Theses of the Institute of Electronics, Information and Communication Engineers* (C), J69-C, 12, pp. 1487–1493 (December, 1986); "Finite-element analysis of inherent mode of waveguide-solution by transverse component of magnetic field", by Matsubara, Angkaew and Kumagai, *Theses of the Institute of Electronics, Information and Communication Engineers* (C), J69-C, pp. 548–553 (May, 1986); "Finite-element analysis of waveguide modes: A novel approach that eliminates spurious modes", *IEEE Transactions on Microwave Theory & Tech.,* MTT-34, 2, (1987); and *The finite element in engineering science*, by O. C. Zienkiewicz, McGraw-Hill (1971).

As to the perturbation method, reference may be made to the following literature: *Electromagnetic wave circuit*, by Konishi, Ohm-sha (1976); *Time-harmonic electromagnetic fields*, McGraw-Hill (1961); and "Way of attack to problems in regard to electromagnetic waves", by Naito et al., *Journal of the Institute of Electronics, Information and Communication Engineers*, Dec. 1, 1977.

Figure 21:
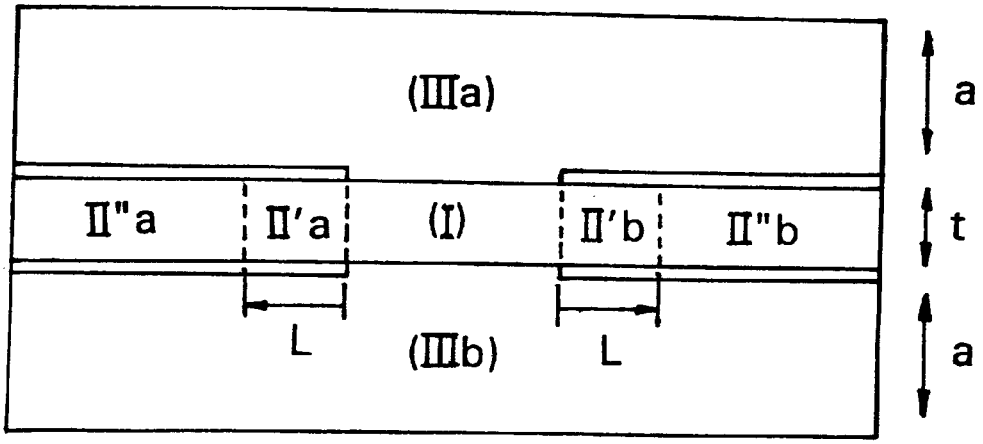
FIG. 21 is a sectional view of the PDTL, illustrative of regions defined within the PDTL, as well as design parameters.

Electric field intensity distribution was determined by using the method described above, with the results that, in the high-frequency range of 20 GHz or higher at which the PDTL is used, the electric field intensity is highest at the locations of the regions IIa, IIb adjacent to the boundary between these regions and the region I and decreases exponentially as the distance from the region I increases. The regions IIa and IIb are further divided into sub-regions IIa', IIa" and IIb', IIb", respectively, as shown in FIG. 21. The ability to confine the electric field energy can be expressed in terms of the relationship between the size of the sub-regions IIa' and IIb', i.e., the length L and the amount of the energy. Since the amount of the electric field energy in each of the regions I to IIIb can be determined independently, it is possible to determine the conditions for achieving such an electric field intensity distribution that 80% or more of the total electric field energy is confined in the regions I and the sub-regions IIa', IIb', as well as conditions for achieving such an electric field intensity distribution that 90% or more of the total electric field energy is confined in the regions I and the sub-regions IIa', IIb'.

Figure 22:
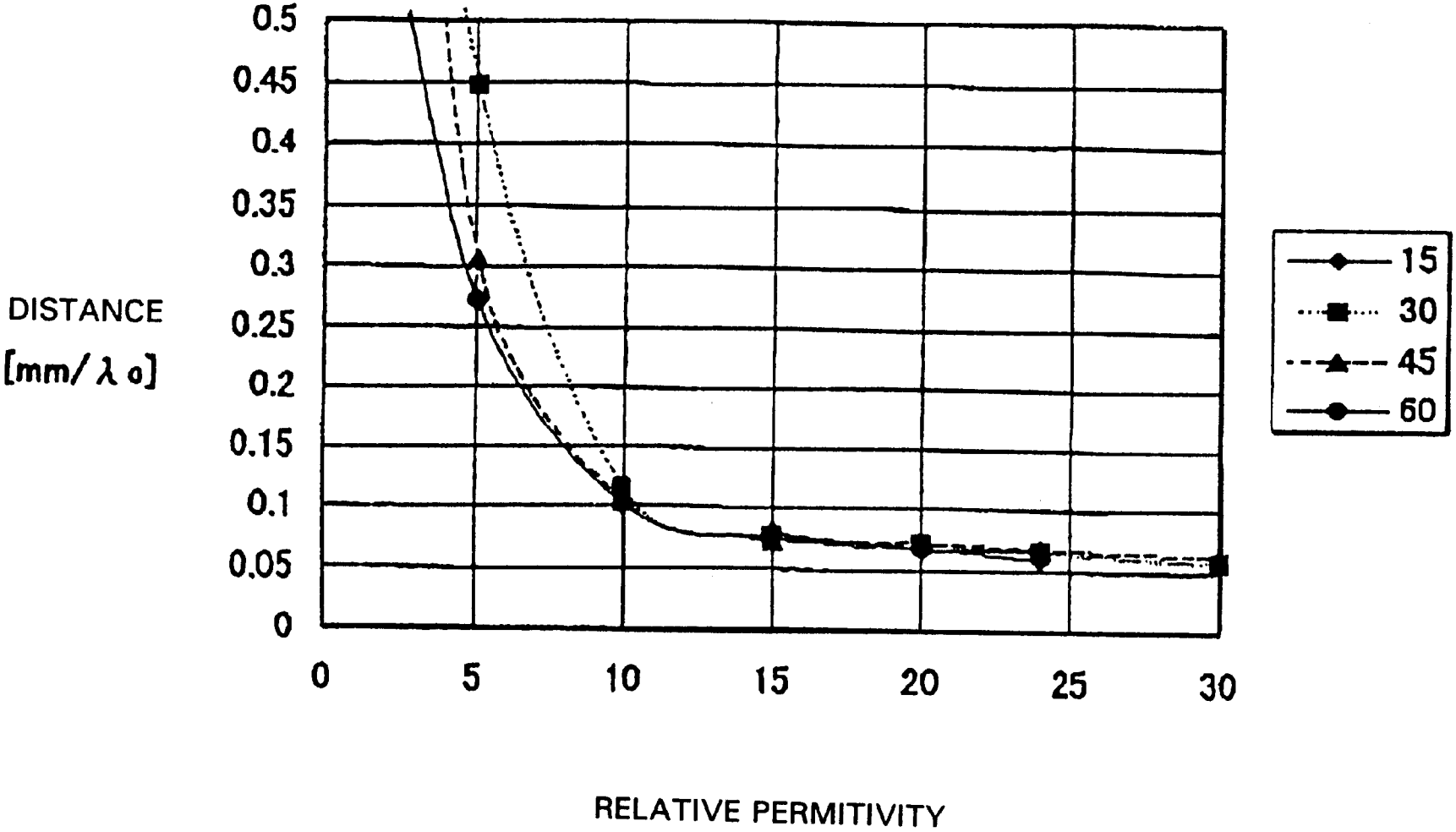
FIG. 22 is a graph showing the relationship between the frequency of an electromagnetic wave and the distance within which 80% or more of the total electric field energy is confined.

FIG. 22 illustrates the relationship between the relative permittivity of the dielectric substrate and the length L which is effective for confining 80% or more of the total electric field energy to be confined in the region I and the sub-regions IIa', IIb', as determined by calculation. The calculation was conducted on a model structure in which the parameters "a" and "t" shown in FIG. 21 were respectively set to "a=1.0 mm" and "t=0.5 mm", while the line width "w" was set to a value which provides a specific impedance of 50 Ω. In FIG. 22, the ordinate axis indicates values which are determined by normalizing the length L by the wavelength of the electromagnetic wave propagated through the dielectric member, while the abscissa axis indicates the relative permittivity of the dielectric substrate. Four different frequencies: namely, 15 GHz, 30 GHz, 45 GHz and 60 GHz, were employed as parameters. From this Figure, it is understood that the length L which ensures that 80% or more of the total electric field energy is confined in ranges between 0.05 to 0.13 times the wavelength of the electromagnetic wave, regardless of the frequency, when the relative permittivity is 10 or greater.

Figure 23:
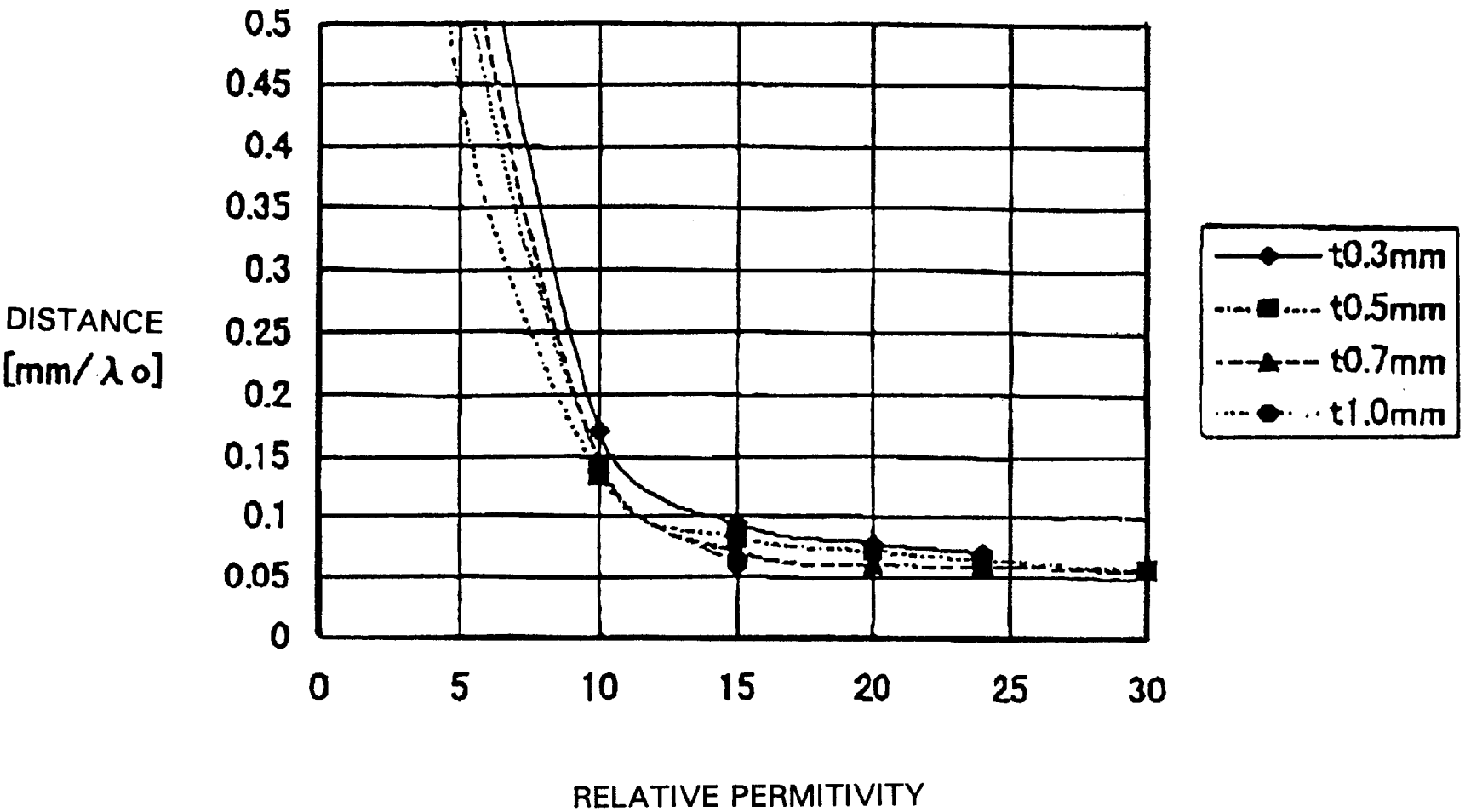
FIG. 23 is a graph showing the relationship between the thickness of the dielectric substrate and the distance within which 80% or more of the total electric field energy is confined.

FIG. 23 shows the relationship between the relative permittivity and the length L, as obtained in a frequency range of 30 GHz or higher, when the parameter "a" was set to "a=0.7 mm" and the width w was set to provide an impedance of 50 Ω, with four different substrate thicknesses "t" of 0.3 mm, 0.5 mm, 0.7 mm and 1.0 mm. As in the case of FIG. 22, the ordinate axis indicates values of the length L normalized by the effective wavelength. From this Figure, it is understood that 80% or more of the electric field energy is confined in the region of the length L which is not greater than 0.2 times the wavelength, under the conditions of the relative permittivity being 10 or greater and the thickness "t" of the dielectric substrate being 0.3 mm or greater.

In order that the required high scale of integration of the circuit can be obtained, it is effective that 80% or more of the total electric field energy is confined within the region of the length L which is not greater than 0.2 times the wavelength. From FIGS. 22 and 23, it is understood that this goal can be met when the following conditions are satisfied:

(relative permittivity of dielectric substrate)≧10 (thickness "t" of dielectric substrate)≧0.3 mm.

In addition, due to structural restrictions on the PDTL, the thickness "t" of the dielectric substrate and the thickness "a" of the air layer are not greater than half of the desired wavelengths, in order to suppress unnecessary coupling with parallel planar mode. Namely, it is important that the following conditions are met:

$t \leqq \lambda_g/2$ $\lambda_g$: wavelength in dielectric substrate $a \leqq \lambda_0/2$ $\lambda_0$: free space wavelength.

Figure 24:
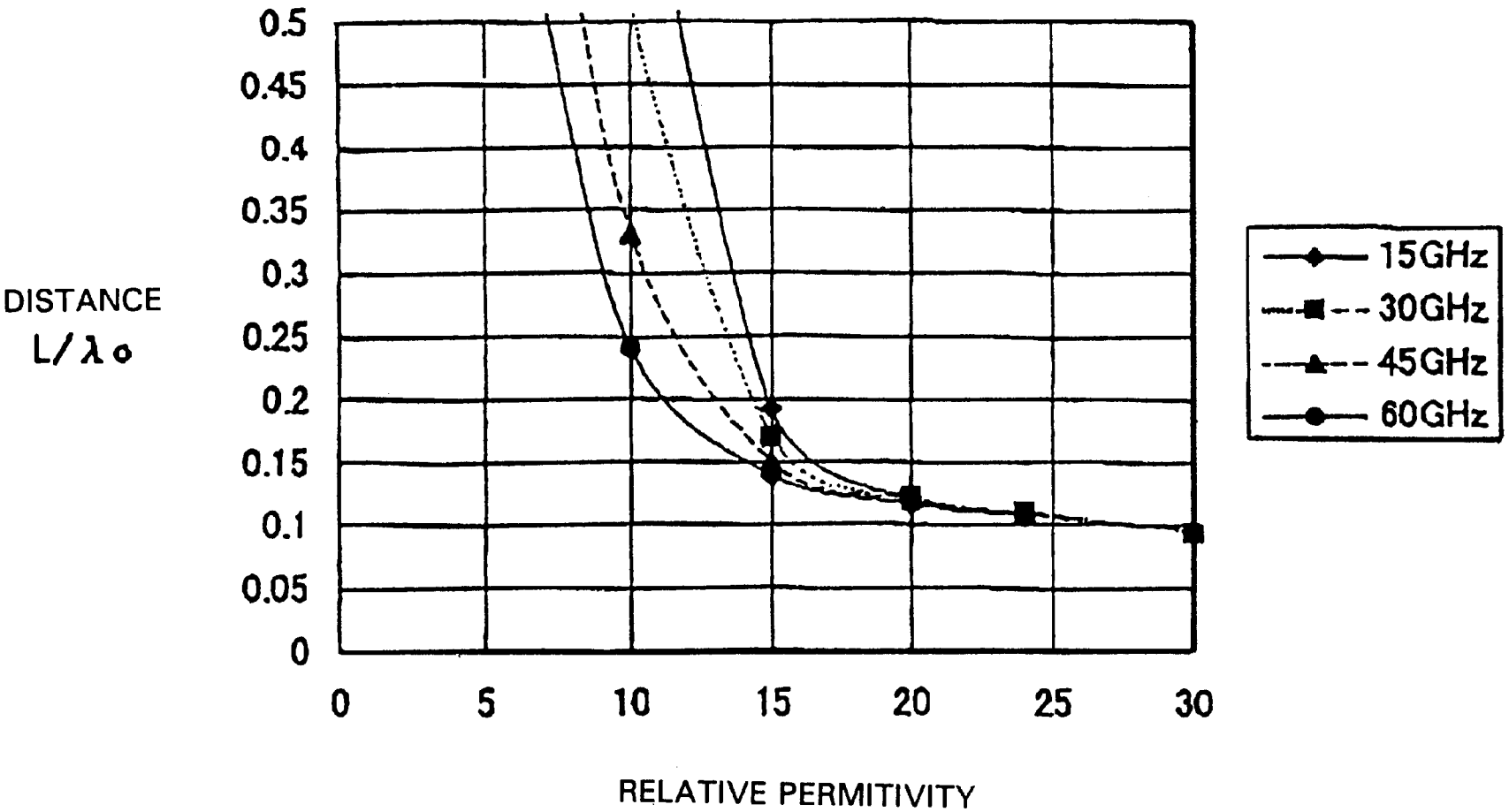
FIG. 24 is a graph showing the relationship between the frequency of an electromagnetic wave and the distance within which 90% or more of the total electric field energy is confined.

FIG. 24 illustrates the relationship between the relative permittivity of the dielectric substrate and the length L which is effective for confining 90% or more of the total electric field energy to be confined in the region I and the sub-regions IIa', IIb', as determined by calculation. The calculation was conducted on a model structure in which the parameters "a" and "t" shown in FIG. 21 were respectively set to "a=0.7 mm" and "t=0.5 mm", while the line width "w" was set to a value which provides a particular impedance of 50 Ω. In FIG. 22, the ordinate indicates values which are determined by normalizing the length L by the wavelength of the electromagnetic wave propagated through the dielectric member, while the abscissa indicates the relative permittivity of the dielectric substrate. Four different frequencies: namely, 15 GHz, 30 GHz, 45 GHz and 60 GHz, were employed as parameters. From this Figure, it is understood that the length L which ensures that 80% or more of the total electric field energy is confined ranges between 0.1 to 0.15 times the wavelength of the electromagnetic wave, regardless of the frequency, when the relative permittivity is 10 or greater.

Figure 25:
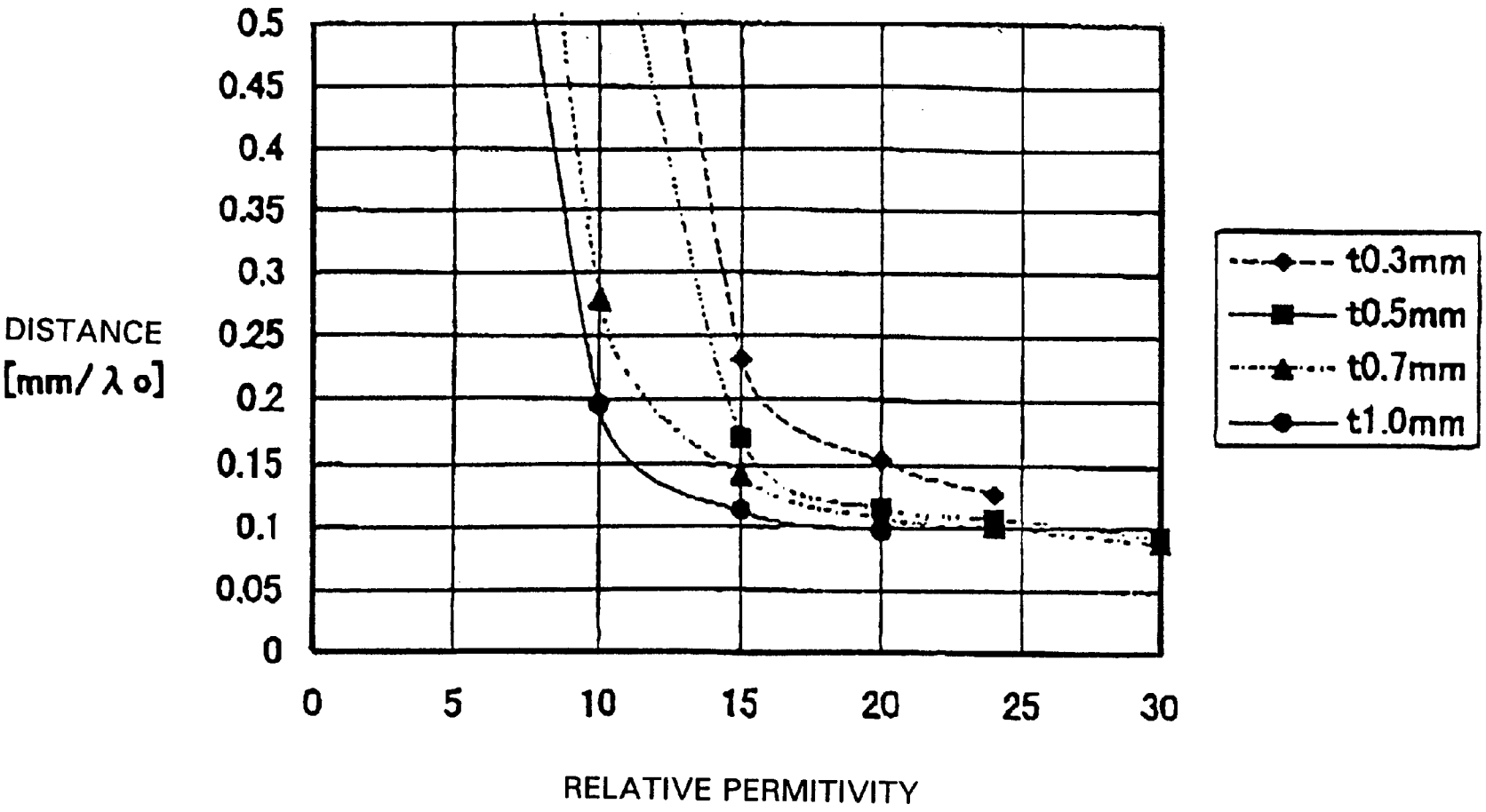
FIG. 25 is a graph showing the relationship between the thickness of the dielectric substrate and the distance within which 90% or more of the total electric field energy is confined.

FIG. 25 shows the relationship between the relative permittivity and the length L, as obtained in a frequency range of 30 GHz or higher, when the parameter "a" was set to "a=1.0 mm" and the width w was set to provide an impedance of 50 Ω, with four different substrate thicknesses "t" of 0.3 mm, 0.5 mm, 0.7 mm and 1.0 mm. As in the case of FIG. 24, the ordinate indicates values of the length L normalized by the effective wavelength. From this Figure, it is understood that 90% or more of the electric field energy is confined in the region of the length L which is not greater than 0.2 times the wavelength, under the conditions of the relative permittivity being 18 or greater and the thickness "t" of the dielectric-substrate being 0.3 mm or greater.

From FIGS. 22 and 23, it is understood that the goal of 90% or more of the total electric field energy to be confined within the region of the length L which is not greater than 0.2 times the wavelength, for achieving the desired scale of integration, can be met when the following conditions are satisfied:

(relative permittivity of dielectric substrate)≧18 (thickness "t" of dielectric substrate)≧0.3 mm.

In addition, due to structural restrictions on the PDTL, the thickness "t" of the dielectric substrate and the thickness "a" of the air layer are not greater than half of the desired wavelengths, in order to suppress unnecessary coupling with the parallel planar mode. Namely, it is effective that the following conditions are met:

$t \geqq \lambda_g/2$ $\lambda_g$: wavelength in dielectric substrate $a \geqq \lambda_0/2$ $\lambda_0$: free space wavelength.

Figure 26:
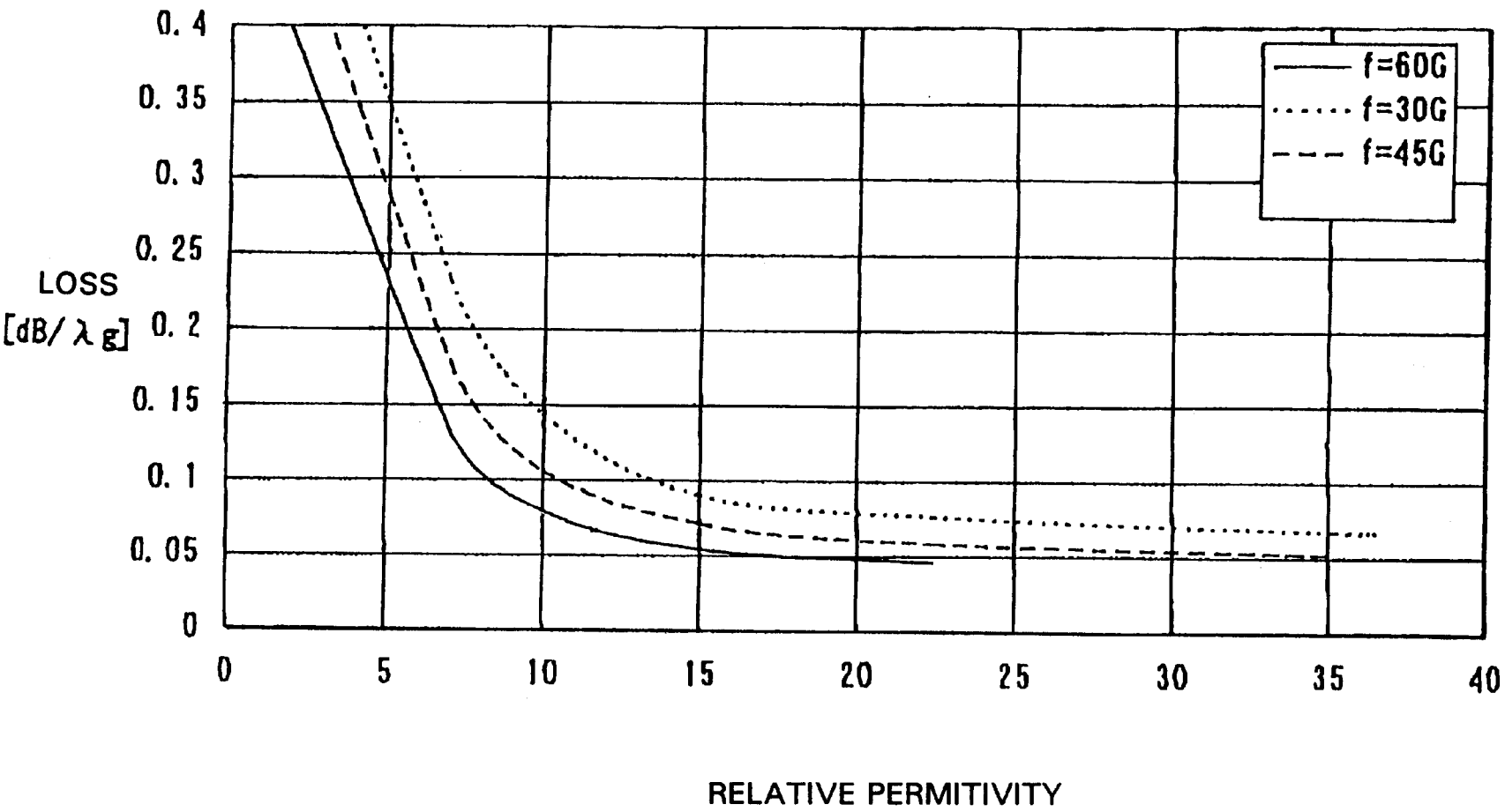
FIG. 26 is a graph showing the relationship between the frequency dependence of loss and relative permittivity.
Figure 27:
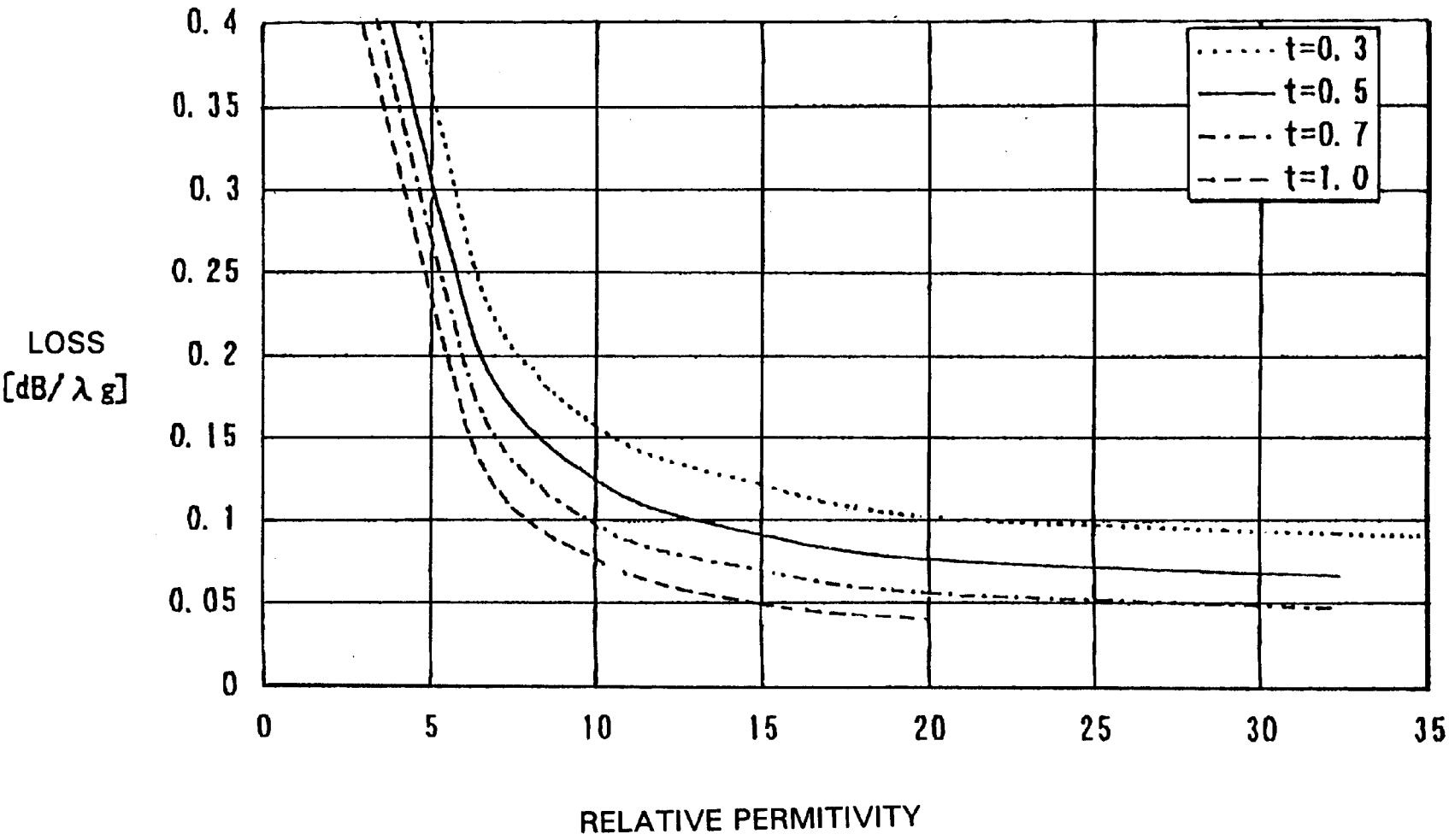
FIG. 27 is a graph showing the relationship between relative permittivity and loss.

Satisfaction of the foregoing conditions not only implements greater scale of circuit integration through confinement of energy, but also reduces transmission loss along the line, as will be understood from the following description taken in conjunction with FIGS. 26 and 27. More specifically, FIG. 26 shows the relationship between the transmission loss per wavelength, which is shown along the ordinate axis, and the relative permittivity of the dielectric substrate, which is shown along the abscissa axis, as observed at each of the frequencies of 30 GHz, 45 GHz and 60 GHz. As in the case of FIG. 22, the parameters "a" and "t" are respectively set to "a=1.0 mm" and "t=0.5 mm", while the line width "w" is set to a value which provides the inherent impedance of 50 Ω. Similarly, FIG. 27 shows the relationship between the transmission loss per wavelength (ordinate axis) and the relative permittivity of the dielectric substrate, with the substrate thickness "t" as a parameter set to 0.3 mm, 0.5 mm, 0.7 mm and 1.0 mm. In FIG. 27, as in the case of FIG. 23, the structural parameter "a" is set to be "a=1.0 mm" and the line width "w" is set to the value which provides the inherent impedance of 50 Ω, while the frequency was selected to be 30 GHz.

The characteristics shown in FIG. 27 are those within the ranges which meet the conditions for confining 80% or greater of the total electric field energy, as well as those within the ranges which meet the conditions for confining 90% or greater of the total electric field energy. It will be seen from this Figure that the transmission loss is small as compared with those experienced with microstrip lines which are used in the millimeter-wave band. More specifically, the transmission loss is as small as 0.2 dB/$\lambda_g$ when the conditions for confining 80% or greater of the energy are met. Moreover, when the conditions for confining 90% or greater of the energy are satisfied, the transmission loss is further reduced to 0.15 dB/$\lambda_g$.

As will be understood from the foregoing description, the PDTL in accordance with the present invention offers the following advantages.

Firstly, electronic devices can be designed and constructed in reduced sizes and design precision can be enhanced, by virtue of elimination of parasitic coupling.

Secondly, electric power efficiency can be improved through reduction in the transmission loss along the line.

It is possible to obtain a line-integrated filter, by arranging the PDTL in parallel with a TE010 mode resonator. It is also possible to obtain an ultra-small MIC integrating a passive element and an active element, by forming semiconductor devices on the PDTL.

Although the present invention has been described in relation to particular embodiments thereof, many other variations and modifications and other uses will become apparent to those skilled in the art. Therefore, the present invention is not limited by the specific disclosure herein.

What is claimed is:

1. A planar dielectric line comprising:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing; and a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

wherein the permittivity and the thickness of said dielectric substrate are determined so that said planar dielectric line confines about 80 percent or more of energy of a signal propagating in said dielectric substrate between said first and second slots and meets the following conditions:

relative permittivity of dielectric substrate$\geqq$10 thickness "t" of dielectric substrate$\geqq$0.3 mm;

and further comprising:

first and second conductive substrates, and first and second air layers defined respectively between said first and second conductive substrates, and said first and second surfaces of said dielectric substrate;

wherein the thickness "t" of said dielectric substrate and the thickness "a" of each said air layer are determined to meet the following conditions:

$t \leqq \lambda_g/2$ $\lambda_g$: wavelength in dielectric substrate $a \leqq \lambda_0/2$ $\lambda_0$: free space wavelength.

2. A planar dielectric line comprising:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing; and a second slot having substantially the same width as said first slot and being interposed between third and fourth electrodes, opposedly facing said first slot, said third and fourth electrodes being formed on the second surface of said dielectric substrate and opposedly facing each other across a predetermined spacing, wherein the permittivity and the thickness of said dielectric substrate are determined to meet the following conditions:

relative permittivity of dielectric substrate$\geqq$18 thickness "t" of dielectric substrate$\geqq$0.3 mm.

3. A planar dielectric line of claim 2, further comprising first and second conductive substrates, and first and second air layers defined respectively between said first and second conductive substrates, and said first and second surfaces of said dielectric substrate; wherein the thickness "t" of said dielectric substrate and the thickness "a" of each said air layer are determined to meet the following conditions:

$t \leqq \lambda_g/2$ $\lambda_g$: wavelength in dielectric substrate $a \leqq \lambda_0/2$ $\lambda_0$: free space wavelength.

4. A planar dielectric line according to claim 2, wherein said planar dielectric line confines about 90 percent or more of energy of a signal propagating in said dielectric substrate between said first and second slots.

5. A planar dielectric line according to claim 3, wherein said planar dielectric line confines about 90 percent or more of energy of a signal propagating in said dielectric substrate between said first and second slots.

6. An integrated circuit comprising a plurality of planar dielectric lines each of which comprises:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing; and a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

wherein the permittivity and the thickness of said dielectric substrate are determined so that said planar dielectric line confines about 80 percent or more of energy of a signal propagating in said dielectric substrate between said first and second slots and meets the following conditions:

relative permittivity of dielectric substrate$\geqq$10 thickness "t" of dielectric substrate$\geqq$0.3 mm;

wherein at least one of said first and second slots has a narrowed bent portion.

7. An integrated circuit comprising a plurality of planar dielectric lines each of which comprises:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing; and a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

wherein the permittivity and the thickness of said dielectric substrate are determined so that said planar dielectric line confines about 80 percent or more of energy of a signal propagating in said dielectric substrate between said first and second slots and meets the following conditions:

relative permittivity of dielectric substrate≧10 thickness "t" of dielectric substrate≧0.3 mm;

and further comprising first and second conductive substrates, and first and second air layers defined respectively between said first and second conductive substrates, and said first and second surfaces of said dielectric substrate;

wherein the thickness "t" of said dielectric substrate and the thickness "a" of each said air layer are determined to meet the following conditions:

$t \geqq \lambda_g/2$ $\lambda_g$: wavelength in dielectric substrate $a \geqq \lambda_0/2$ $\lambda_0$: free space wavelength.

8. An integrated circuit comprising a plurality of planar dielectric lines each of which comprises:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing; and a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

wherein the permittivity and the thickness of said dielectric substrate are determined so that said planar dielectric line confines about 80 percent or more of energy of a signal propagating in said dielectric substrate between said first and second slots;

and further comprising first and second conductive substrates, and first and second air layers defined respectively between said first and second conductive substrates, and said first and second surfaces of said dielectric substrate;

wherein the thickness "t" of said dielectric substrate and the thickness "a" of each said air layer are determined to meet the following conditions:

$t \geqq \lambda_g/2$ $\lambda_g$: wavelength in dielectric substrate $a \geqq \lambda_0/2$ $\lambda_0$: free space wavelength;

and wherein the permittivity and the thickness of said dielectric substrate are determined to meet the following conditions:

relative permittivity of dielectric substrate≧18 thickness "t" of dielectric substrate≧0.3 mm.

9. An integrated circuit according to claim 8, wherein said planar dielectric line confines about 90 percent or more of energy of a signal propagating in said dielectric substrate between said first and second slots.

10. An integrated circuit comprising a plurality of planar dielectric lines each of which comprises:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing; and a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

wherein the permittivity and the thickness of said dielectric substrate are determined so that said planar dielectric line confines about 80 percent or more of energy of a signal propagating in said dielectric substrate between said first and second slots; and wherein the permittivity and the thickness of said dielectric substrate are determined to meet the following conditions:

relative permittivity of dielectric substrate≧18 thickness "t" of dielectric substrate≧0.3 mm.

11. An integrated circuit according to claim 10, wherein said planar dielectric line confines about 90 percent or more of energy of a signal propagating in said dielectric substrate between said first and second slots.

12. A planar dielectric line comprising:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing;

a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

a fifth electrode opposedly facing said first slot, first electrode and second electrode across a respective distance; and a sixth electrode opposedly facing said second slot, third electrode and fourth electrode across a respective distance;

wherein the permittivity and the thickness of said dielectric substrate, the distance between said first slot and said fifth electrode, and the distance between said second slot and said sixth electrode are determined so that said planar dielectric line confines about 80 percent or more of energy of a signal propagating in said dielectric substrate between said first and second slots.

13. A planar dielectric line according to claim 12, wherein said planar dielectric line confines about 90 percent or more of energy of a signal propagating in said dielectric substrate between said first and second slots.

14. An integrated circuit comprising a plurality of planar dielectric lines each of which comprises:

a dielectric substrate having first and second surfaces which opposedly face each other;

a first slot having a predetermined width and being interposed between first and second electrodes, said first and second electrodes being formed on the first surface of said dielectric substrate and opposedly facing each other across a predetermined spacing;

a second slot having substantially the same width as said first slot and being interposed between third and fourth electrodes, opposedly facing said first slot, said third and fourth electrodes being formed on the second surface of said dielectric substrate and opposedly facing each other across a predetermined spacing;

a fifth electrode opposedly facing said first slot, first electrode and second electrode across a respective distance; and a sixth electrode opposedly facing said second slot, third electrode and fourth electrode across a respective distance;

wherein the permittivity and the thickness of said dielectric substrate, the distance between said first slot and said fifth electrode, and the distance between said second slot and said sixth electrode are determined so that said planar dielectric line confines about 80 percent or more of energy of a signal propagating in said dielectric substrate between said first and second slots.

15. An integrated circuit according to claim 14, wherein said planar dielectric line confines about 90 percent or more of energy of a signal propagating in said dielectric substrate between said first and second slots.

* * * * *